US005389284A

United States Patent [19]

van der Hoeven et al.

[11] Patent Number: 5,389,284

[45] Date of Patent: Feb. 14, 1995

[54] LIQUID CLEANING PRODUCTS HAVING IMPROVED STORAGE CAPACITY WITHOUT SETTLING

[75] Inventors: Philippus C. van der Hoeven, Prinsenbeek; Arie van der Linden, Maarssen; Pieter Versluis, Vlaardungen; Terence A. Clarke, Voorschoten, all of Netherlands

[73] Assignee: Lever Brothers Company, Division of Conopco, Inc., New York, N.Y.

[21] Appl. No.: 631,761

[22] Filed: Dec. 21, 1990

Related U.S. Application Data

[63] Continuation of Ser. No. 115,065, Oct. 27, 1987, abandoned.

[30] Foreign Application Priority Data

Oct. 30, 1986 [GB] United Kingdom ..... 8625974

[51] Int. Cl.[6] ..... C11D 1/722; C11D 1/12

[52] U.S. Cl. ..... 252/174.22; 252/540; 252/559; 252/143; 252/DIG. 1; 252/DIG. 14

[58] Field of Search ..... 252/174.22, DIG. 1, 252/DIG. 14, 142, 143, 540, 559

[56] References Cited

U.S. PATENT DOCUMENTS

| | | | |
|---|---|---|---|
| 3,630,929 | 12/1971 | van Dijk et al. | 252/135 |
| 4,264,466 | 4/1981 | Carleton et al. | 252/99 |
| 4,347,152 | 8/1982 | Wixon | 252/174.25 |
| 4,647,393 | 3/1987 | Ouhadi | 252/174.22 |
| 4,655,954 | 4/1987 | Broze et al. | 252/174.19 |
| 4,743,394 | 5/1988 | Kaufmann et al. | 252/90 |
| 4,830,782 | 5/1989 | Broze et al. | 252/135 |

FOREIGN PATENT DOCUMENTS

| | | |
|---|---|---|
| 0028849 | 5/1981 | European Pat. Off. . |
| 0030096 | 6/1981 | European Pat. Off. . |
| 131394 | 1/1985 | European Pat. Off. . |
| 0158464 | 3/1985 | European Pat. Off. . |
| 0217454 | 9/1986 | European Pat. Off. . |
| 0225654 | 10/1986 | European Pat. Off. . |
| 0233730 | 8/1987 | European Pat. Off. . |
| 61-042597 | 3/1986 | Japan . |
| 61-227828 | 10/1986 | Japan . |
| 61-227829 | 10/1986 | Japan . |
| 61-227830 | 10/1986 | Japan . |
| 61-227831 | 10/1986 | Japan . |
| 61-227832 | 10/1986 | Japan . |
| 1205711 | 9/1970 | United Kingdom . |
| 1270040 | 4/1972 | United Kingdom . |
| 1292352 | 10/1972 | United Kingdom . |
| 1600981 | 10/1981 | United Kingdom . |
| 2158453 | 11/1985 | United Kingdom . |
| 2158454 | 11/1985 | United Kingdom . |
| 2158838 | 11/1985 | United Kingdom . |
| 2158839 | 11/1985 | United Kingdom . |
| 2168995 | 7/1986 | United Kingdom . |
| 2169613 | 7/1986 | United Kingdom . |
| 2172897 | 10/1986 | United Kingdom . |
| 2173224 | 10/1986 | United Kingdom . |
| 2177716 | 1/1987 | United Kingdom . |
| 2178753 | 2/1987 | United Kingdom . |
| 2178754 | 2/1987 | United Kingdom . |

(List continued on next page.)

OTHER PUBLICATIONS

Chem. Abstracts 105:81244u (1986) (No month available).

"Inleiding in de Reologie", Dr. Ir. C. Blom et al., Kluwer Technische Boeken, Deventer, 1986, p. 147 (No month available).

*Primary Examiner*—Stephen Kalafut
*Assistant Examiner*—J. Silbermann
*Attorney, Agent, or Firm*—Ronald A. Koatz

[57] ABSTRACT

Non-aqueous liquid cleaning products are formulated by dispersing particulate solids in an organic solvent by using a structurant or deflocculant which causes a viscosity reduction at low shear rates in that solids/solvent system or an equivalent system in which the solids volume fraction is sufficiently high to raise the viscosity of the solvent. The organic solvent may be liquid surfactant and/or other kind. The solids are any usable in liquid cleaning products. The structurant is any acid, salt or base which fulfils the aforementioned test.

7 Claims, No Drawings

FOREIGN PATENT DOCUMENTS

| | | |
|---|---|---|
| 2179364 | 3/1987 | United Kingdom . |
| 2179365 | 3/1987 | United Kingdom . |
| 2180551 | 4/1987 | United Kingdom . |
| 2187199 | 9/1987 | United Kingdom . |
| 2194536 | 3/1988 | United Kingdom . |
| 2194546 | 3/1988 | United Kingdom . |
| 2194555 | 3/1988 | United Kingdom . |
| 2195123 | 3/1988 | United Kingdom . |
| 2195124 | 3/1988 | United Kingdom . |
| 2195125 | 3/1988 | United Kingdom . |
| 2195649 | 4/1988 | United Kingdom . |
| 2196347 | 4/1988 | United Kingdom . |
| 2196981 | 5/1988 | United Kingdom . |

LIQUID CLEANING PRODUCTS HAVING IMPROVED STORAGE CAPACITY WITHOUT SETTLING

This is a continuation application of Ser. No. 115,065, filed Oct. 27, 1987, now abandoned.

The present invention relates to non-aqueous liquid cleaning products, especially detergent compositions containing particulate solid salts. Non-aqueous liquids are those containing little or no water.

In liquid detergents in general, especially those for the washing of fabrics, it is often desired to suspend particulate solids which have beneficial auxiliary effects in the wash, for example detergency builders to counteract water hardness, as well as bleaches. To keep the solids in suspension, some kind of stabilising system is necessary. In aqueous detergent liquids (i.e. those containing substantial amounts of water), this is often achieved either by 'external structuring' i.e. adding an additional component such as a network forming polymer, or using the interaction of the water in the liquid and the detergent actives themselves, to form an 'internal structure' to support the solids. However, there is considerable interest in non-aqueous liquids which, because they contain little or no water, can act as a vehicle for a wider range of components which are often mutually incompatible in aqueous systems. A prime example of this is enzymes and bleaches, which have a tendency to mutual decomposition.

Several different approaches have been used to provide solid-suspending properties in non-aqueous liquids. These are somewhat analogous to the external structuring techniques used in aqueous systems; i.e., in addition to the particulate solids and the liquid phase in which they are to be suspended, an additional structurant is used which by one means or another, acts to aid stable suspension of the solids for a finite period. As used herein and unless indicated to the contrary, the term 'structurant' is meant to be construed in this widest sense.

In the prior art, a number of structurant systems have been described. The applicants believe that in some cases, the mechanism of action of these has been wrongly interpreted, or at least has been partly misunderstood. Indeed, they are of the opinion that in some cases, materials have previously been incorporated in non-aqueous systems without it being realised that they are acting as structurants.

Before defining the scope of the present invention, it is necessary to set it in the context of the prior art. However, a consideration of the prior art is more illuminating if first it is explained that the present invention is based on a phenomenon which the applicants have discovered enables formulation of a very wide range of non-aqueous liquid detergent products. This allows selection of components to be far less restrictive than has been necessary hitherto, so that ingredients can now be chosen to avoid many problems which have been unavoidable previously, for example undesirable rheological properties, or the need to use materials which are undesirable on environmental or cost grounds.

Stated simply, this phenomenon occurs in the use of solvent/structurant combinations which seem to result in a repulsive force between particles placed in the solvent. This will be elaborated in more detail hereinbelow, but it must be stressed that this 'force' may only be an apparent effect and constitutes no more than a theory by which the applicants have found it convenient to describe the phenomenon. It is not presented as in any way defining or restricting the scope of the invention. It is presented here merely as an aid to understanding.

It could be that the apparent force is merely a reduction in or destruction of the affinity between individual particles, so that instead of agglomerating to form flocs, they sediment-out in the solvent as slowly as possible, at a rate determined by Stokes' law. The apparent force may also be sufficient to mitigate or completely counteract any network formation by the particles, which would otherwise lead to setting (solidification). Setting can be partly or wholly reversible, or irreversible, depending on the degree of network formation and the force applied in an attempt to break it down. The apparent force could also be of sufficient strength that the repulsion between the particles will inhibit sedimenting, i.e. it could be a positive suspending force. It may be that the way which the apparent force acts could vary according to the quantities and types of the materials (solvents, solids and structurants) used, or there could be a spectrum with all of these effects occurring simultaneously, each to a different relative degree.

In any event, it can be stated that many examples of the invention have been subjected to detailed scrutiny by the applicants. In all cases it was observed that even after sedimentation is seen to occur, either upon prolonged storage, or by being artificially accelerated, the particles will not actually agglomerate but remain distinct and appear unable to approach one another closer than a certain minimum distance. For this reason, the applicants refer to the phenomenon described above as 'deflocculation'.

Finally, for the avoidance of doubt, it should be noted that in the context of the present invention and unless stated to the contrary, the term solvent means the liquid in which the particulate solids are dispersed or suspended by the structurant. It may consist solely or partly of a liquid surfactant, or comprise a non-surfactant. Where the solvent is entirely non-surfactant, there may or may not be present, surfactant in the form of solids suspended or dissolved in the solvent.

Turning now to the prior art, the applicants believe that some examples of non-aqueous liquid detergents previously described, contain solids stably dispersed or suspended by virtue of the deflocculation effect, although this was not previously understood or described. Naturally, any such examples are disclaimed from the ambit of the present invention.

An early means attempted for the stable suspension of solids in non-aqueous system was to use nonionic surfactant as the solvent and to add an inorganic carrier material, in particular highly voluminous silica to form a solid-suspending network. This silica was highly voluminous by virtue of having an extremely small particle size, hence high surface area. This is described in GB patent specifications 1,205,711 and 1,270,040. A gross problem with these compositions is setting upon prolonged storage. A similar structuring has been effected using fine particulate Chain structure-type clay, as described in specification EP-A-34,387.

As described in specification GB 1 292 352, the rate of dissolution in water of the systems structured with an inorganic carrier material is improved by incorporation of a small amount of a proton-donating acid substance. Although not recognised up to the present, the applicants through their researches, now believe that in those systems, the proton-donating acid substance could have played a role similar to that fulfilled by deflocculating structurants in the compositions of the present invention.

Later, another acid substance used as a stabiliser in nonionic-based non-aqueous compositions was a hydrolyzable co-polymer of maleic anhydride with ethylene or vinylmethylether, which co-polymer is at least 30% hydrolyzed. This is described in specification EP-A-28,849. A problem with these compositions is the difficulty in controlling manufacture to obtain reproducible product stability.

More recently, there have been two series of patent applications published which disclose further developments in non-aqueous liquid detergent compositions. For the first of these, the named applicant is Colgate. The applications are as follows, and for convenience will thereafter be referred to by the bracketed references shown.

(C1) GB 2 158 453 A (C8) GB 2 177 716 A
(C2) GB 2 158 454 A (C9) GB 2 178 753 A
(C3) GB 2 158 838 A (C10) GB 2 178 754 A
(C4) GB 2 168 995 A (C11) GB 2 179 346 A
(C5) GB 2 169 613 A (C12) GB 2 179 365 A
(C6) GB 2 172 897 A (C13) GB 2 180 551 A
(C7) GB 2 173 224 A (C14) GB 2 187 199 A (C15) DE 37 04 903 A

Specifications (C1)–(C7) were published before the date of filing of the application from which the present case claims priority, (C8)–(C15) afterwards.

Around the same time, the following applications, also relating to non-aqueous liquid detergents, were published in the name of Nippon Oils and Fats (again for convenience, bracketed reference are allocated):

(N1) J 61 227 828
(N2) J 61 227 829
(N3) J 61 227 830
(N4) J 61 227 831
(N5) J 61 227 832

These were all published before the priority date of the present invention.

The Colgate specifications are all concerned with dispersions of detergency builders, and optionally, other materials, in a solvent comprising a nonionic surfactant. For the most part, these builders are of the phosphate or aluminosilicate type. However, systems where the builder is heptonic acid or alginic acid alkali metal salt are described in (C9) whereas those with aluminosilicate/nitrilotriacetate (NTA) combinations are described in (C10), whilst (C13) describes systems wherein the builder is an alkali metal salt of a lower polycarboxylic acid. In (C14) the builder is a linear long chain (20–30 phosphorus atoms) condensed polyphosphoric acid or an alkali-metal or ammonium salt thereof. Also, (C2) and (C3) describe use of sequestrant sodium salts, namely of certain acetic or phosphonic acid derivatives, which have some acidic character, although these are not described as structurants.

In these Colgate systems, sedimentation is preferably inhibited by using solids with particle sizes below 10 microns, as is claimed in (C3). This is also the subject of at least one earlier disclosure, EP-A-30,096 (ICI). However, 'stability' is said to be enhanced by various 'anti-settling' agents. According to (C1), one such agent is an organic phosphorus compound having an acidic —POH group. This is also essentially disclosed in (N5). According to (C6), the agent may be the aluminium salt of a higher aliphatic carboxylic acid, or as described in (C11), a cationic quaternary amine salt surfactant, urea, or a substituted-urea or -guanidine. Substituted-ureas are also described as such dispersants in (N2), whilst comparable use of substituted-urethanes is the subject of (N3).

According to the Colgate disclosures, such anti-settling agents increase the yield value of the composition. Yield value is a reference to a phenomenon whereby on progressive application of shear stress to a viscous liquid, no measurable flow occurs (apparent infinite viscosity) until a critical 'yield value' is obtained. Once shear stress is increased beyond that value, flow commences and viscosity decreases in an approximately linear fashion. In fact, many rheologists now believe that 'yield stress' or existence of a 'yield value' is only an apparent effect and is only a result of the way in which viscosity vs shear rate plots are determined experimentally. Probably, a more accurate description is that viscosity decrease is highly non-linear at low shear rates applied progressively from rest. Nevertheless, it can be conjectured that the observed increase in yield value on application of an 'anti-settling agent' is effectively an increase in viscosity of the liquid at low shear rate.

In contrast, the present invention (as will be explained in more detail hereinbelow) entails use of structurants which in general decrease viscosity, particularly at low shear rates. Incidentally, the anti-settling agents are also hypothesised in the aforementioned prior disclosures, as 'wetting' the surface of the particulate solids, conferring on them, a more lipophilic character.

Many of the compositions exemplified in the Colgate specifications also use certain anti-gelling agents which improve dispersability on contact with water. These are said to confer the additional property of lowering the viscosity of the undiluted composition. The kind of anti-gelling agent used in many examples is that claimed in (C2). These agents are polyether carboxylic acids. However, (C8) claims anti-gelling use of aliphatic linear dicarboxylic acids containing at least about 6 aliphatic carbon atoms or aliphatic monocyclic dicarboxylic acids in which one of the carboxylic acid groups is bonded directly to a ring carbon atom and the other is bonded to the monocyclic ring through an alkyl or alkenyl chain of at least about 3 carbon atoms. In addition, according to (C15), a combination or complex of a quaternary ammonium salt cationic surfactant and an acid-terminated nonionic (optionally in excess, thereby said to control viscosity) produces a fabric softening effect.

The present applicants believe that although not realised by the applicants of the latter applications, these carboxylic acid derivatives could act as structurants in a similar manner to the structurants used in the present invention. Indeed, (N1) claims use of fatty acid alkanolamide di-esters of dicarboxylic acids actually as dispersants. Analogous dispersants but where the ester is formed with a carboxylated polymer, optionally only partially esterified (including salt forms thereof) is the subject of (N5).

According to a first aspect, the present invention now provides a substantially non-aqueous liquid cleaning product comprising a non-aqueous organic solvent, particles of solid material dispersed in the solvent and a structurant which comprises one or more deflocculants in an amount sufficient substantially to deflocculate said particles, with the provisos that when the solvent comprises nonionic surfactant and the particles comprise a detergency builder, then (A) the composition contains less than an effective structuring amount of inorganic carrier material (as hereinafter defined); and (B) the structurant comprises at least one material not selected from the following:

a) an organic phosphorus compound having an acidic —POH group;

b) an aluminium salt of a higher aliphatic carboxylic acid;

c) a cationic quaternary ammonium salt surfactant alone or together or in complex with an acid-terminated nonionic surfactant which acidified nonionic may also be in excess to the cationic or complex;

d) urea or a substituted-urea -urethane or -guanidine;

e) a polyether carboxylic acid, or an aliphatic linear dicarboxylic acid containing at least about 6 aliphatic carbon atoms, or an alphatic monocyclic dicarboxylic acid in which one carboxyl group is bonded directly to a ring carbon atom and the other is bonded to the monocyclic ring through an alkyl or alkenyl chain of at least about 3 carbon atoms, or a fatty acid alkanolamide di-ester of a dicarboxylic acid;

f) any acidic polymer material wherein substantially all acid substituent groups are carboxyl groups or any such material where substantially all the carboxyl groups are esterified with fatty acid dialkanolamide moieties; and g) a sequestering agent which is the sodium salt of an acetic or phosphonic acid derivative, or is a linear long chain condensed polyphosphoric acid or alkali metal or ammonium salt thereof.

The foregoing provisos are intended to disclaim all structured non-aqueous compositions disclosed in the prior art discussed above. In particular, they account for previously described agents which may be structurants, whether or not they are described as such in the relevant prior art documents.

Proviso (A) is in relation to specification GB 1 292 352 and the term 'inorganic carrier material' is ascribed the meaning given to it in the latter specification. In other words, it refers to 'a highly voluminous metal oxide or metalloid oxide having a particle size of from 1 to 100 mμ, an average surface area of 50–800 $m^2/g$ and a bulk density of from 10–180 g/l '.

The provisos (B) are all in relation to the Colgate and Nippon Oils and Fats disclosures referred to specifically above, but part (f) is also in relation to the compositions described in specification EP-A-28,849.

The first aspect of the present invention requires use of at least one deflocculant and this is the fundamental integer on which this aspect is based. The deflocculation effect has been studied by the applicants who, although not wishing to be bound by any particular theory or interpretation, advance the following as one possible explanation of this phenomenon.

The prior art compositions which use an inorganic carrier material (a highly voluminous metal oxide or metalloid oxide) as a structurant have poor water dispersibility unless a small amount of proton-donating acid substance is also added (according to GB 1 292 352). In fact, the applicants have now found that without such acid, those compositions also have the disadvantage of setting (solidification) upon prolonged storage although even with the acid, those systems still show a setting tendency in the longer term. The applicants proceeded to discover that in very many organic solvents, nearly all dispersed solid particles (if small enough), seem progressively to form a loose network with the end result of setting, provided that the volume fraction of finely divided solids in the solvent is sufficiently high. Addition of a deflocculant when formulating these potentially setting systems has been found to inhibit (i.e. delay or indefinitely prevent) such setting. The deflocculant appears to cause the particles to remain distinct and not form a network.

At lower volume fraction levels, the particles just tend to agglomerate (which accelerates phase separation) but deflocculants also inhibit this agglomeration.

Deflocculation would seem to be due to effects at the surfaces of the particles of solid. It could be due to an ion-exchange effect leading to a net charge on the surfaces which as a result would repel one another, the strength and distance of action of the repulsive force being governed by Coulomb's law. This theory is supported by the observation that the deflocculation effect is more marked in solvents which have low dielectric-constants. Also, subjecting the resultant compositions to an electrostatic field can be seen to cause a species migration.

Alternatively, or in addition to an ion-exchange process, deflocculation could be due to formation of a surface molecular layer on the particles which lowers their frictional interaction and perhaps also keeps them apart by molecular steric effects.

As well as the deflocculant, the solvent itself may also play a role in either ion-exchange or molecular layer formation.

The result of deflocculation may also manifest itself in either or both of two effects. First, individual particles (as opposed to agglomerates) will settle more slowly at a rate predicted by Stokes' law. If the particles are small enough, this settling will occur extremely slowly. The phenomenon of slow settling of small particles is itself described in prior art specifications (C3) and EP-A-30,096. This very slow settling can for all practical purposes be regarded as stability (if defined as resistance to phase separation).

However, in any event, when particles do settle (which will happen faster or slower, depending on the viscosity of the liquid phase, the volume fraction of solids and the size of the particles) they will assume a final settled volume in which they still display deflocculated behaviour, i.e. they move easily relative to one another so that the viscosity of the settled layer is quite low. The particles will not set into a compacted layer because deflocculation appears to prevent them approaching one another within less than a certain minimum distance of separation. This in itself may be the reason for the apparent lack of friction between the particles, or it could be due to the nature of molecular layers hypothesised above, which may be able to move relative to one another with minimal frictional interaction.

Whatever the exact causes of this behaviour, it enables three product forms to be realised. The first of these entails systems in which the size of particles is small enough and the solvent viscous enough that the particles settle very slowly and no more phase separation is observed than 1% by volume in 1 week, preferably in 1 month, preferably 3 months. Such products are most suited where low volume fractions of solids are required, yet only minimal visible phase separation is tolerable over the period from manufacture, through storage, until use.

The second form is where low volume fractions of solids are required but visible phase separation can be tolerated. Here the particle size/solvent viscosity combination results in rapid settling, in particular a phase separation of more than 1% by volume in one week. However, the liquid can be made substantially homogeneous, e.g. by stirring or shaking just prior to use.

In both of the above-mentioned product forms, the deflocculant confers the advantage of inhibiting setting of the bulk of the liquid by network formation or the formation of a compacted settled solids layer which is not readily re-dispersible in the solvent. Whatever the rate of sedimentation of solids in either product form, this rate is minimised by the deflocculation effect preventing individual particles from agglomerating into larger flocs which then settle more rapidly.

The third product form corresponds to the composition of the final settled layer which will develop eventually if liquids of either of the first two product forms are left to stand. The minimum volume which this layer assumes will be approached asymptotically with progression of time. However, for all practical purposes, after standing a sample of either of the first two product forms for sufficient time, the volume of the settled layer will not substantially decrease further. The composition of that layer can then be analysed by means which will be known to those skilled in the art and this substantially constitutes the composition of a liquid of the third product form.

To formulate a product in the latter category, it is therefore convenient to disperse all major solids in excess solvent and with an amount of deflocculant which can be optimised by a means which will be described hereinbelow. Thus, this dispersion can be left to assume the final settled volume, the composition of which is then analysed. In a new composition made-up according to this latter formulation, all minor ingredients can be dissolved and/or dispersed and the sample stored to determine compatibility of the components, optionally followed by minor adjustments in amounts and types of solids, solvents and structurant to achieve the required balance of rheology, performance and manufacturing cost.

However, the first need is to select a combination of solids, solvent and structurant in which deflocculation can occur. It will be appreciated that the present invention enables each of these ingredients, in principle, to be selected from an extremely wide range. It is most likely that for a given product to be formulated, it will be desired to select the solvent and solids from within certain classes dictated by the intended product application. From within such classes, the solids are preferably selected in the form of a powder with a very small particle size, say less than 10 microns. If not already available in such fine form, the solids can be taken in coarser form and ground by appropriate means, such as in a suitable ball mill. The solids are then added progressively (with stirring) to a solvent selected from within the required class until sufficient are added, that a substantial viscosity rise is apparent (i.e. the mixture thickens visibly). A sample potential structurant is then added progressively until deflocculation is detected. If it is not observed at any level of potential structurant, that material is unsuitable in that particular solids/solvent system and another should be tried.

In its most marked degree, deflocculation is apparent by a readily discernable thinning (viscosity reduction) at some point during addition of structurant whilst stirring. However, the main means of quantitative detection of deflocculation is identification of a viscosity reduction at low shear rates (e.g. at or around 5 $s^{-1}$) as measured in a suitable rheometer. In the context of the present invention, the term 'deflocculant' is defined as a material which fulfils such a test of viscosity reduction at low shear rate. Preferably, at at least some structurant level, at such a shear rate, a viscosity reduction of 25% should be observed, although 50% reduction or even of a whole order of magnitude is even more indicative of a structurant with good deflocculant properties. Although the deflocculants reduce the viscosity of the system, many products according to the invention are still quite viscous at low shear rates (e.g. $>1$Pas) but they are very shear thinning and so are relatively pourable.

In some cases, it will be acceptable to have products where the deflocculation effect is only sufficient to delay setting, so that it remains pourable for a finite time within which it is to be used. In other words, when the deflocculation effect is not strong enough to prevent setting in the longer term. However, in the most preferred embodiments, compositions according to the present invention are substantially non-setting. Those which would eventually set can be eliminated by storing samples at or around 50° C. for 48 hours, 64 hours or more and observing whether solidification occurs. In the context of the present invention, the term 'non-setting' refers to a composition which has a viscosity below 10 Pas at a shear rate of 5 $s^{-1}$ or more, on storage at 50° C. for 64 hours immediately after preparation. The applicants have found that the 'anti-settling agents' described in the aforementioned Colgate disclosures result in compositions which eventually set upon storage at ambient or elevated temperatures.

Thus, a second aspect of the present invention provides a non-setting liquid cleaning product comprising a non-aqueous organic solvent, particles of solid material dispersed in the solvent and a structurant. It will be recalled that the applicants believe that certain known viscosity reducing carboxylate (selected carboxy, di-carboxy or cyclic di-carboxy) anti-gelling agents may, without having been recognised as such, acted as effective structurants. However, as is demonstrated by way of example hereinbelow, with these, the visocsity reduction is only temporary and setting occurs in the test defined above.

Once a suitable deflocculant has been identified (for use in a composition according to any aspect of the invention), the optimum amount of structurant can be determined by varying the amount of structurant added to the pre-selected solids/solvent combination and measuring the sedimentation rate at each value. Sedimentation rate can be measured by standing the liquid in a measuring cylinder or other suitable vessel and determining the rate of sinking of the upper surface of the settled layer. If these experiments are then repeated at different solids volume fraction levels, for each structurant level, the sedimentation rate can be plotted against volume fraction level and the plot extrapolated to the zero solids axis. The intercept is a prediction of the sedimentation rate of a single particle in isolation in the solvent. By application of Stokes' law, an apparent particle size can be calculated as is known, e.g. from A J G van Diemen et al, J Colloid & Interface Sci, 104 (1985) 87–94.

The apparent particle size will generally be found to decrease as the structurant level is increased, until an approximate plateau is reached, the onset of which represents an optimum concentration for that structurant in that solids/solvent system.

It is interesting to note that reduction of apparent particle size is suggestive of a true deflocculant effect, as is known in the technical literature, e.g. 'Inleiding in de Reologie', Dr Ir C Blom et al, Kluwer Technische Boeken, Deventer, 1986, P. 147. This tends to support the tentative theories by which the applicants have attempted to explain the present invention. Further supportive evidence has been obtained by the applicants by studying examples of the aforementioned third product form. These represent the maximum volume fraction of solids which can be incorporated in such a system. From a knowledge of the average particle size of the solids before incorporation, and assuming optimum packing of the particles, a 'calculated particle size' in the liquid can be calculated using the known total volume of the liquid. This calculated particle size has been found by the applicants to be somewhat greater than the apparent particle size calculated from Stokes' law.

The implication of this comparison is that there is a radius beyond the physical boundary of each particle which is the limit of permissible closest approach, again suggesting an electrostatic or molecular 'shield' created around each particle.

Having selected a viable solids/solvent/deflocculant combination, an appropriate final product can then be formulated as indicated above. However, it is appropriate here to describe typical and preferred classes and sub-classes of ingredients which can be used, although this is not to be taken as in any way limited of the scope of the present invention. In the broadest definition of the invention, except for disclaimed prior art, the applicants put no pre-condition on the chemical classes from which the solvent, solids and structurant should be selected. The sole criterion is a combination which fulfils the deflocculation test defined above. However, there now follows a description of preferred groups of ingredients, as well as an indication of some general rules for selection of materials which the applicants have found particularly useful for expediting identification of combinations which will give the desired result in the deflocculation test.

All compositions according to the present invention are liquid cleaning products. They may be formulated in a very wide range of specific forms, according to the intended use. They may be formulated as cleaners for hard surfaces (with or without abrasive) or as agents for warewashing (cleaning of dishes, cutlery etc.) either by hand or mechanical means, as well as in the form of specialised cleaning products, such as for surgical apparatus or artificial dentures. They may also be formulated as agents for washing and/or conditioning of fabrics.

In the case of hard-surface cleaning, the compositions may be formulated as main cleaning agents, or pre-treatment products to be sprayed or wiped on prior to removal, e.g. by wiping off or as part of a main cleaning operation.

In the case of warewashing, the compositions may also be the main cleaning agent or a pre-treatment product, e.g. applied by spray or used for soaking utensils in an aqueous solution and/or suspension thereof.

Those products which are formulated for the cleaning and/or conditioning of fabrics constitute an especially preferred form of the present invention because in that role, there is a very great need to be able to incorporate substantial amounts of various kinds of solids. These compositions may for example, be of the kind used for pre-treatment of fabrics (e.g. for spot stain removal) with the composition neat or diluted, before they are rinsed and/or .subjected to a main wash. The compositions may also be formulated as main wash products, being dissolved and/or dispersed in the water with which the fabrics are contacted. In that case, the composition may be the sole cleaning agent or an adjunct to another wash product. Within the context of the present invention, the term 'cleaning product' also embraces compositions of the kind used as fabric conditioners (including fabric softeners) which are only added in the rinse water (sometimes referred to as 'rinse conditioners').

Thus, the compositions will contain at least one agent which promotes the cleaning and/or conditioning of the article(s) in question, selected according to the intended application. Usually, this agent will be selected from surfactants, enzymes, bleaches, microbiocides, (for fabrics) fabric softening agents and (in the case of hard surface cleaning) abrasives. Of course in many cases, more than one of these agents will be present, as well as other ingredients commonly used in the relevant product form.

The compositions will be substantially free from agents which are detrimental to the article(s) to be treated. For example, they will be substantially free from pigments or dyes, although of course they may contain small amounts of those dyes (colourants) of the kind often used to impart a pleasing colour to liquid cleaning products, as well as fluorescers, bluing agents and the like.

Examples of substantially surfactant-free products according to the present invention are enzyme-based pre-treatment products for spot-stain removal in fabrics and bleach products of the kind which in some countries, it is conventional to add to the wash liquor, part-way through the wash process. Of course both such products may be formulated in alternative forms which do contain surfactant.

Apart from the structurant, all ingredients before incorporation will either be liquid, in which case, in the composition they will constitute all or part of the solvent, or they will be solids, in which case, in the composition they will either be dispersed as deflocculated particles in the solvent or they will be dissolved in the solvent. Thus as used herein, the term solids is to be construed as referring to materials in the solid phase which are added to the composition and are dispersed therein in solid form, those solids which dissolve in the solvent and those in the liquid phase which solidify (undergo a phase change) in the composition, wherein they are then dispersed.

Some liquids are alone, unlikely to be suitable to perform the function of solvent for any combination of solids and deflocculant. However, they will be able to be incorporated if used with another liquid which does have the required properties, the only requirement being that where the solvent comprises two or more liquids, they are miscible when in the total composition or one can be dispersible in the other, in the form of fine droplets.

Thus, where surfactants are solids, they will usually be dissolved or dispersed in the solvent. Where they are liquids, they will usually constitute all or part of the solvent. However, in some cases the solvents may undergo a phase change in the composition, Also, as will be explained further hereinbelow, some surfactants are also eminently suitable as deflocculants. In general, they may be chosen from any of the classes, sub-classes and specific materials described in 'Surface Active Agents' Vol. I, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch' H Stache, 2nd Edn., Carl Hanser Verlag, München & Wien, 1981.

In respect of all surfactant materials, but also with reference to all ingredients described herein as examples of components in compositions according to the present invention, unless the context requires otherwise, the term alkyl refers to a straight or branched alkyl moiety having from 1 to 30 carbon atoms, whereas lower alkyl refers to a straight or branched alkyl moiety of from 1 to 4 carbon atoms. These definitions apply to alkyl species however incorporated (e.g. as part of an aralkyl species). Alkenyl (olefin) and alkynyl (acetylene) species are to be interpreted likewise (i.e. in terms of configuration and number of carbon atoms) as are equivalent alkylene, alkenylene and alkynylene linkages. For the avoidance of doubt, any reference to lower alkyl or $C_{1-4}$ alkyl (unless the context so forbids) is to be taken specifically as a recitation of each species wherein the alkyl group is (independent of any other alkyl group which may be present in the same molecule) methyl, ethyl, iso-propyl, n-propyl, n-butyl, iso-butyl and t-butyl, and lower (or $C_{1-4}$) alkylene is to be construed likewise.

Liquid surfactants are an especially preferred class of solvent, especially polyalkoxylated types and in particular polyalkoxylated nonionic surfactants.

As a general rule, the applicants have found that the most suitable liquids to choose as the organic solvents are those having polar molecules. In particular, those comprising a relatively lipophilic part and a relatively hydrophilic part, especially a hydrophilic part rich in electron lone pairs, tend to be well suited. This is completely in accordance with the observation that liquid surfactants, especially polyalkoxylated nonionics, are one preferred class of solvent.

Nonionic detergent surfactants are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and di-alkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in the applicants' published European specification EP-A-225,654, especially for use as all or part of the solvent. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide. These may be used as the sole nonionic surfactants or in combination with those of the described in the last-mentioned European specification, especially as all or part of the solvent.

Another class of suitable nonionics comprise the alkyl polysaccharides (polyglycosides/oligosaccharides) such as described in any of specifications U.S. Pat. Nos. 3,640,998; 3,346,558; 4,223,129; EP-A-92,355; EP-A-99,183; EP 70,074, '75, '76, '77; EP 75,994, '95, '96.

Nonionic detergent surfactants normally have molecular weights of from about 300 to about 11,000. Mixtures of different nonionic detergent surfactants may also be used, provided the mixture is liquid at room temperature. Mixtures of nonionic detergent surfactants with other detergent surfactants such as anionic, cationic or ampholytic detergent surfactants and soaps may also be used. If such mixtures are used, the mixture must be liquid at room temperature.

Examples of suitable anionic detergent surfactants are alkali metal, ammonium or alkylolamaine salts of alkylbenzene sulphonates having from 10 to 18 carbon atoms in the alkyl group, alkyl and alkylether sulphates having from 10 to 24 carbon atoms in the alkyl group, the alkylether sulphates having from 1 to 5 ethylene oxide groups, olefin sulphonates prepared by sulphonation of $C_{10}$–$C_{24}$ alpha-olefins and subsequent neutralization and hydrolysis of the sulphonation reaction product.

Other surfactants which may be used include alkali metal soaps of a fatty acid, preferably one containing 12 to 18 carbon atoms. Typical such acids are oleic acid, ricinoleic acid and fatty acids derived from caster oil, rapeseed oil, groundnut oil, coconut oil, palmkernal oil or mixtures thereof. The sodium or potassium soaps of these acids can be used. As well as fulfilling the role of surfactants, soaps can act as detergency builders or fabric conditioners, other examples of which will be described in more detail hereinbelow. It can also be remarked that the oils mentioned in this paragraph may themselves constitute all or part of the solvent, whilst the corresponding low molecular weight fatty acids (triglycerides) can be dispersed as solids or function as structurants.

Yet again, it is also possible to utilise cationic, zwitterionic and amphoteric surfactants such as referred to in the general surfactant texts referred to hereinbefore. Examples of cationic detergent surfactants are aliphatic or aromatic alkyl-di(alkyl) ammonium halides and examples of soaps are the alkali metal salts of $C_{12}$–$C_{24}$ fatty acids. Ampholytic detergent surfactants are e.g. the sulphobetaines. Combinations of surfactants from within the same, or from different classes may be employed to advantage for optimising structuring and/or cleaning performance.

Non-surfactants which are suitable as solvents include those having the preferred molecular forms referred to above although other kinds may be used, especially if combined with those of the former, more preferred types. In general, the non-surfactant solvents can be used alone or with in combination with liquid surfactants. Non-surfactant solvents which have molecular structures which fall into the former, more preferred category include ethers, polyethers, alkylamines and fatty amines, (especially di- and tri-alkyl- and/or fatty-N-substituted amines), alkyl (or fatty) amides and mono- and di- N-alkyl substituted derivatives thereof, alkyl (or fatty) carboxylic acid lower alkyl esters, ketones, aldehydes, and glycerides. Specific examples include respectively, di-alkyl ethers, polyethylene glycols, alkyl ketones (such as acetone) and glyceryl trialkylcarboxylates (such as glyceryl tri-acetate), glycerol, propylene glycol, and sorbitol.

Many light solvents with little or no hydrophilic character are in most systems, unsuitable on their own (i.e. deflocculation will not occur in them). Examples of these are lower alcohols, such as ethanol, or higher alcohols, such as dodecanol, as well as alkanes and olefins. However, they can be combined with other solvent materials which are surfactants or non-surfactants having the aforementioned 'preferred' kinds of molecular structure. Even though they appear not to play a role in the deflocculation process, it is often desirable to include them for lowering the viscosity of the product and/or assisting soil removal during cleaning.

Preferably, the compositions of the invention contain the organic solvent (whether or not comprising liquid surfactant) in an amount of at least 10% by weight of the total composition. The amount of the solvent present in the composition may be as high as about 90%, but in most cases the practical amount will lie between 20 and 70% and preferably between 20 and 50% by weight of the composition.

In principle, any material may be used as a deflocculant provided it fulfils the deflocculation test hereinbefore described and provided the resulting composition is not thereby excluded by the aforementioned provisos (A) and (B) recited in the definition of the first aspect of the invention. It will be recalled that capability of a substance to act as a deflocculant will partly depend on the solids/solvent combination.

However, especially preferred are acids. In the narrowest sense, these are regarded as substances which in aqueous media are capable of dissociating to produce hydrogen ions ($H^+$), which in aqueous systems can be regarded as existing in the form $H_3O^+$. In non-aqueous systems, it is not necessarily meaningful to describe acids in those terms but it is still a convenient definition for present purposes. Also, a substance which can lose a proton ($H^+$) is often termed a 'Bronsted Acid'. There is also a wider definition, that is, a substance which can accept a pair of electrons. Such an acid according to this definition is often called a Lewis acid.

Bronsted acids constitute a preferred group of acid deflocculants, especially inorganic mineral acids and alkyl-, alkenyl-, aralkyl- and aralkenyl-sulphonic or mono-carboxylic acids and halogenated derivatives thereof, as well as acidic salts (especially alkali metal salts) of these. Compositions which are substantially free from inorganic carrier material (as hereinbefore defined) and comprise a non-aqueous organic solvent, particles of solid material dispersed in the solvent and one or more structurants selected from the latter group, constitute a third aspect of the present invention.

Some typical examples from within the latter group include the alkanonic acids such as acetic, propionic and stearic and their halogenated counterparts such as trichloracetic and trifluoracetic as well as the alkyl (e.g. methane) sulphonic acids and aralkyl (e.g. paratoluene) sulphonic acids.

Examples of suitable inorganic mineral acids and their salts are hydrochloric, carbonic, sulphurous, sulphuric and phosphoric acids; potassium monohydrogen sulphate, sodium monohydrogen sulphate, potassium monhydrogen phosphate, potassium dihydrogen phosphate, sodium monohydrogen phosphate, potassium dihydrogen pyrophosphate, tetrasodium monohydrogen triphosphate.

In addition to the acid and acidic salt structurants defined in the third aspect of the invention, other organic acids may also be used as deflocculants, for example formic, lactic, citric, amino acetic, benzoic, salicylic, phthalic, nicotinic, ascorbic, ethylenediamine tetraacetic, and aminophosphonic acids, as well as longer chain fatty carboxylates and triglycerides, such as oleic, stearic, lauric acid and the like. Peracids such as percarboxylic and persulphonic acids may also be used.

The class of acid deflocculants further extends to the Lewis acids, including the anhydrides of inorganic and organic acids. Examples of these are acetic anhydride, maleic anhydride, phthalic anhydride and succinic anhydride, sulphur-trioxide, diphosphorous pentoxide, boron trifluoride, antimony pentachloride.

It may be that these Lewis acid structurants act in their unaltered state at the surface of the dispersed particles to cause deflocculation or they could form Bronsted acids by reaction with trace quantities of water in the liquid or indeed by reaction with the solvent itself. In the widest sense, acid deflocculants include any substance or combination of substances which form a generally acidic substance in situ in the composition. Acids are especially suited as structurants for solids which have a basic character to a greater or lesser extent. However, in some systems, particularly where the solids are acidic in nature, bases may be used.

In the most broad interpretation, it can be stated that 'deflocculant' includes any substance which is converted in situ in the product to form another substances which causes deflocculation, as well as including that other substance so formed. It is also feasible for a deflocculant not to be added separately but to already be present as an impurity in one of the other components of the product, for example the solvent. In respect of all deflocculants/structurants recited herein, it is also possible to formulate products which contain two or more of such materials, whether added separately or as a mixture thereof.

Suitable deflocculants are also found amongst salts. Already mentioned are salts with a hydrogen content such that they case release a proton, for example the alkali metal hydrogen phosphates and hydrogen sulphates. However, other organic and inorganic salts may be used successfully, according to the nature of the solids/solvent combination. It could be that these salts effectively act as Lewis acids or it may be that they are in themselves capable of promoting an ion-exchange mechanism at the surface of the solid particles.

The applicants have found that usually, it is preferably to choose a salt which has a cation which is different from and especially, more electropositive than, any cation of the major part of the solids. However, in some situations this does not always apply. Also, it is preferable that the anion of the salt structruant is soluble in the solvent. Thus, for example, when the solids mainly comprise alkali metal salts, it is desirable to select a salt of a transition metal, such as ferric or manganese chloride. It is also desirable for the structurant anion to be organic and when the solvent is a surfactant, for the structurant anion to comprise the residue of a fatty or long chain carboxylic acid. In that situation, for example, cupric stearates, oleates, palmitates etc may be used.

It is also preferred to choose salts having at least one moiety with a good complex forming ability, for example a quaternary ammonium ion or an appropriate transition metal ion. This is perhaps the reason why the particular salts mentioned in the preceding paragraph tend to produce the required deflocculant effect.

The salts with good complex forming ability do however sometimes (perhaps by virtue of that property) tend to result in setting (solidification) in the longer term, despite initially causing deflocculation. Thus in some cases, they are best used in combination with surfactant structurants of the kind to be described hereinafter.

Another preferred class of salts for this purpose are the alkali-metal sulphosuccinate di-alkyl derivatives such as that sold under the trade name Aerosol OT. When these are used, it may be necessary to heat the product to initiate deflocculation. Di-alkyl sulphosuccinate salts which may be used also include those described in specification EP-A-208,440 which include ammonium as well as alkali-metal salts. The free acid di-alkyl sulphosuccinate acids may also be used. It is further possible to use the substantially anhydrous aluminosilicates (including zeolites) as structurants/deflocculants. These are sometimes referred to an 'activated' types. One such is 'activated zeolite 4A' sold by Degussa. These are even capable of deflocculating partially or fully hydrated aluminosilicates. Although network formation is promoted by trace quantities of water in the composition and it could be said that the substantially anhydrous aluminosilicates merely absorb this, that may not be the primary effect because the same behaviour has not been observed using anhydrous calcium chloride which has a very marked water-absorbing capability.

It is also possible to use salts with organic cations.

The observation that when the solvent comprises a liquid surfactant (or similar substance with a fatty residue), 'fatty' anions are very suitable structurants, has lead the applicants to discover that a particularly preferred class of structurants comprises anionic surfactants. Although anionics which are salts of alkali or other metals may be used, (especially having regard to the aforementioned desirable relative electropolarities of the solids and deflocculant cations), particularly preferred are the free acid forms of these surfactants (wherein the metal cation is replaced by an $H^+$ cation, i.e. proton). Thus, the systems where particulate solids are dispersed in an organic solvent by a structurant comprising an anionic surfactant (at least one component of the structurant being other than the polyether carboxylate, di-carboxylate or monocyclic carboxylate nonionic derivative anti-gelling agents described by Colgate or Nippon Oils and Fats) constitutes a further aspect of the present invention.

These anionic surfactants include all those classes, sub-classes and specific forms described in the aforementioned general references on surfactants, viz, Schwartz & Perry, Schwartz Perry and Berch, McCutcheon's, Tensid-Taschenbuch; and the free acid forms thereof. Many anionic surfactants have already been described hereinbefore. In the role of structurants, the free acid forms of these are generally preferred.

One particularly preferred sub-class of such anionic surfactants is defined as a compound of formula (I)

$$R\text{-}L\text{-}A\text{-}Y \qquad (I)$$

wherein R is a linear or branched hydrocarbon group having from 8 to 24 carbon atoms and which is saturated or unsaturated;

L is absent or represents -O-, -S-, -Ph-, or -Ph-O- (where Ph represents phenylene), or a group of formula $-CON(R^1)-$, $-CON(R^1)R^2-$ or $-COR^2-$, wherein $R^1$ represents a straight or branched $C_{1-4}$ alkyl group and $R^2$ represents an alkylene linkage having from 1 to 5 carbon atoms and is optionally substituted by a hydroxy group;

A is absent or represents from 1 to 12 independently selected alkenyloxy groups; and Y represents $-SO_3H$ or $-CH_2SO_3H$ or a group of formula $-CH(R_3)COR^4$ wherein $R^3$ represents $-OSO_3H$ or $-SO_3H$ and $R^4$ independently represents $-NH_2$ or a group of formula $-OR^5$ where $R^5$ respresents hydrogen or a straight or branched $C_{1-4}$ alkyl group and salts, particularly metal, more especially alkali metal salts thereof. However, the free acid forms thereof are the most preferred.

Especially preferred of the free acid forms are those wherein L is absent or represents -O-, -Ph- or -Ph-O-; A is absent or represents from 3 to 9 ethoxy, i.e. $-(CH_2)_2O-$ or propoxy, i.e. $-(CH_2)_3O-$ groups or mixed ethoxy/-propoxy groups; and Y represents $-SO_3H$ or $-CH_2SO_3H$.

The alkyl and alkyl benzene sulphates, and sulphonates, as well as ethoxylated forms thereof, and also analogues wherein the alkyl chain is partly unsaturated, are particularly preferred.

It will be appreciated that although the definition of R covers chains of from 8 to 24 carbon atoms, most commercially available surfactants are mixtures with pairs or narrow ranges of carbon chain lengths e.g. $C_{9-11}$, $C_{12-15}$, $C_{13-15}$ etc and anionics having single, dual or narrow-range mixes of chain lengths are encompanied by the general formula (I). In particular, some preferred sub-classes and examples are the $C_{10}$–$C_{22}$ fatty acids and dimers thereof, the $C_8$–$C_{18}$ alkylbenzene sulphonic acids, the $C_{10}$–$C_{18}$ alkyl- or alkylether sulphuric acid monoesters, the $C_{12}$–$C_{18}$ paraffin sulphonic acids, the fatty acid sulphonic acids, the benzene-, toluene-, xylene- and cumene sulphonic acids and so on. Particularly, although not exclusively, preferred are the linear $C_{12}$–$C_{18}$ alkylbenzene sulphonic acids. Here it can be mentioned that specification JP 61042597 (Kao) describes use of an alkylbenzene sulphonic free acid in a non-aqueous paste product. However, in that system, the acid is not acting as a deflocculant. Instead it forms the sodium salt in situ in the composition, to form a thick binary anionic/nonionic system. In fact, air has to be injected to prevent complete solidification.

As well as anionic surfactants, zwitterionic-types can also be used as structurants/deflocculants. These may be any described in the aforementioned general surfactant references. One preferred example is lecithin. Unlike the organic compounds with an acidic -POH group described in (C1), lecithin contains a phosphorous linkage of formula $-O-P(\rightarrow O)(O^-)-O-$.

The surfactant structurants/deflocculants, particularly the anionic free acid and the zwitterionic forms tend to have the advantage, that by using them, setting (solidification) does not occur on prolonged storage and they can even inhibit such setting in systems where other deflocculants on their own are not sufficient for this purpose (e.g. transition metal salts).

The level of the deflocculant material in the composition can be optimised by the means hereinbefore described but in very many cases is at least 0.01%, usually 0.1% and preferably at least 1% by weight, and may be as high as 15% by weight. For most practical purposes, the amount ranges from 2–12%, preferably from 4–10% by weight, based on the final composition.

In addition to the components already discussed, i.e. solvents (both surfactant and non-surfactant), deflocculants (structurants) are those surfactants which fall into the class of particulate solids, there are the very many other ingredients which can be incorporated in liquid cleaning products.

As previously mentioned, any component which is liquid, will form all or part of the solvent and any which is solid will be dispersed and/or dissolved in the liquid, although of course the present invention requires at least some solids to be dispersed. The class 'solids' also includes liquids which on addition to the composition solidify and thereafter are dispersed as finely divided particles. In the following description of other ingreidents, the majority fall into the class of solids but many are liquids. Also, some will be capable of acting as deflocculants according to the solvent/solids combination and as indentified by the test hereinbefore described.

There is a very great range of such other ingredients and these will be chosen according to the intended use of the product. However, the greatest diversity is found in products for fabrics washing and/or conditioning. Many ingredients intended for that purpose will also find application in products for other applictions (e.g. in hard surface cleaners and warewashing liquids).

For convenience only, the other ingredients have been classed as primary and secondary (or minor) ingredients.

The primary ingredients are detergency builders, bleaches or bleach systems, and (for hard surface cleaners) abrasives.

The detergency builders are those materials which counteract the effects of calcium, or other ion, water hardness, either by precipitation or by an ion sequestering effect. They comprise both inorganic and organic builders. They may also be sub-divided into the phosphorus-containing and non-phosphorus types, the latter being preferred when environmental considerations are important.

In general, the inorganic builders comprise the various phosphate-, carbonate-, silicate-, borate- and aliminosilicate-type materals, particularly the alkalimetal salt forms. Mixtures of these may also be used.

Examples of phosphorus-containing inorganic builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates, silicates, metasilicates, and crystalline and amorphous alumino silicates. Specific examples include sodium carbonate (with or without calcite seeds), potassium carbonate, sodium and potassium bicarbonates, silicates and zeolites.

Examples of organic builders include the alkali metal, ammonium and substituted, citrates, succinates, malonates, fatty acid sulphonates, carboxymethoxy succinates, ammonium polyacetates, carboxylates, polycarboxylates, aminopolycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest range and alkanehydroxy phosphonates.

Other suitable organic builders include the higher molecular weight polymers and co-polymers known to have builder properties, for example appropriate polyacrylic acid, polymaleic acid and polyacrylic/-polymaleic acid co-polymers and their salts, such as those sold by BASF under the Sokalan Trade Mark.

The aluminosilicates are an especially preferred class of non-phosphorus inorganic builders. These for example are crystalline or amorphous materials having the general formula:

$$Na_Z(AlO_2)_Z(SiO_2)_y \times H_2O$$

wherein Z and Y are integers of at least 6, the molar ratio of Z to Y is in the range from 1.0 to 0.5, and x is an integer from 6 to 189 such that the moisture content is from about 4% to about 20% by weight (termed herein, 'partially hydrated'). This water content provides the best rheological properties in the liquid. Above this level (e.g. from about 19% to about 28% by weight water content), the water level can lead to network formation. Below this level (e.g. from 0 to about 6% by weight water content), trapped gas in pores of the material can be displaced which causes gassing and tends to lead to a viscosity increase also. However, it will be recalled that anhydrous materials (i.e. with 0 to about 6% by weight of water) can be used as structurants. The preferred range of aluminosilicate is from about 12% to about 30% on an anhydrous basis. The aluminosilicate preferably has a particle size of from 0.1 to 100 microns, ideally betweeen 0.1 and 10 microns and a calcium ion exchange capacity of at least 200 mg calcium carbonate/g.

The second of the major other ingredients consist of the bleaches. These include the halogen, particularly chlorine bleaches such as are provided in the form of alkalimetal hypohalites, e.g. hypochlorites. In the application of fabrics washing, the oxygen bleaches are preferred, for example in the form of an inorganic persalt, preferably with an activator, or as a peroxy acid compound.

In the case of the inorganic persalt bleaches, the activator makes the bleaching more effective at lower temperatures, i.e. in the range from ambient temperature to about 60° C., so that such bleach systems are commonly known as low-temperature bleach systems and are well known in the art. The inorganic persalt such as sodium perborate, both the monohydrate and the tetrahydrate, acts to release active oxygen in solution, and the activator is usually an organic compound having one or more reactive acyl residues, which cause the formation of peracids, the latter providing for a more effective bleaching action at lower temperatures than the peroxybleach compound alone. The ratio by weight of the peroxy bleach compound to the activator is from about 15:1 to about 2:1, preferably from about 10:1 to about 3.5:1. Whilst the amount of the bleach system, i.e. peroxy bleach compound and activator, may be varied between about 5% and about 35% by weight of the total liquid, it is preferred to use from about 6% to about 30% of the ingredients forming the bleach system. Thus, the preferred level of the peroxy bleach compound in the composition is between about 5.5% and about 27% by weight, while the preferred level of the activator is between about 0.5% and about 40%, most preferably between about 1% and about 5% by weight.

Typical examples of the suitable peroxybleach compounds are alkalimetal peroborates, both tetrahydrates and monohydrates, alkali metal percarbonates, persilicates and perphosphates, of which sodium perborate is preferred.

Activators for peroxybleach compounds have been amply described in the literature, including in British patent specifications 836,988, 855,735, 907,356, 907,358, 907,950, 1,003,310, and 1,246,339, U.S. Pat. No. 3,332,882, and 4,128,494, Canadian patent specification 844,481 and South African patent specification 68/6,344.

The exact mode of action of such activators is not known, but it is believed that peracids are formed by reaction of the activators with the inorganic peroxy compound, which peracids then liberate active-oxygen by decomposition.

They are generally compounds which contain N-acyl or O-acyl residues in the molecule and which exert their activating action on the peroxy compounds on contact with these in the washing liquor.

Typical examples of activators within these groups are polyacylated alkylene diamines, such as N,N,N$^1$,N$^1$-tetraacetylethylene diamine (TAED) and N,N,N$^1$,N$^1$-tetraacetylmethylene diamine (TAMD); acylated glycolurils, such as tetraacetylgylcoluril (TAGU); triacetylcyanurate and sodium sulphophenyl ethyl carbonic acid ester.

A particularly preferred activator is N,N,N$^1$,N$^1$-tetraacetylethylene diamine (TAED).

The activator may be incorporated as fine particles or even in granular form, such as described in the applicants' UK patent specification GB 2,053,998 A. Specifically, it is preferred to have an activator of an average particle size of less than 150 micrometers, which gives significant improvement in bleach efficiency. The sedimentation losses, when using an activator with an average particle size of less than 150 μm, are substantially decreased. Even better bleach performance is obtained if the average particle size of the activator is less than 100 μm. However, too small a particle size can give increased decomposition and handling problems prior to processing. However, these particle sizes have to be reconciled with the requirements for dispersion in the solvent (it will be recalled that the aforementioned first product from requires particles which are as small as possible within practical limits). Liquid activators may also be used, e.g. as hereinafter described.

The organic peroxyacid compound bleaches (which in some cases can also act as structurants/deflocculants) are preferably those which are solid at room temperature and most preferably should have a melting point of at least 50° C. Most commonly, they are the organic peroxyacids and water-soluble salts thereof having the general formula

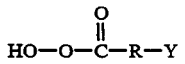

wherein R is an alkylene or substituted alkylene group containing 1 to 20 carbon atoms or an arylene group containing from 6 to 8 carbon atoms, and Y is hydrogen, halogen, alkyl, aryl or any group which provides an anionic moiety in aqueous solution. Such Y groups can include, for example:

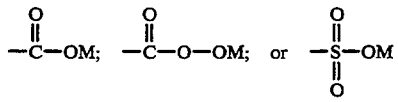

wherein M is H or a water-soluble, salt-forming cation.

The organic peroxyacids and salts thereof usable in the present invention can contain either one, two or more peroxy groups and can be either aliphatic or aromatic. When the organic peroxyacid is aliphitic, the unsubstituted acid may have the general formula:

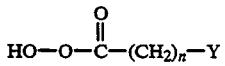

wherein Y can be H, $-CH_3$, $-CH_2Cl$,

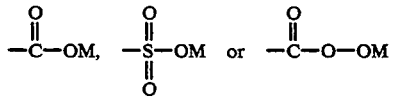

and n can be an integer from 60 to 20. Peroxydodecanoic acids, peroxytetradecanoic acids and peroxyhexadecanoic acids are the most preferred compounds of this type, particularly 1,12-diperoxydodecandioic acid (sometimes known as DPDA), 1,14-diperoxytetradecandioic acid and 1,16-diperoxyhexadecandioic acid. Examples of other preferred compounds of this type are diperoxyazelaic acid, diperoxyadipic and diperoxysebacic acid.

When the organic peroxyacid is aromatic, the unsubstituted acid may have the general formula:

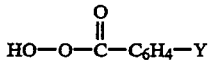

wherein Y is, for example hydrogen, halogen, alkyl,

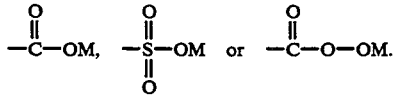

The percarboxy and Y groupings can be in any relative position around the aromatic ring. The ring and/or Y group (if alkyl) can contain any non-interfering substituents such as halogen or sulphonate groups. Examples of suitable aromatic peroxyacids and salts thereof include monoperoxyphthalic acid, diperoxyterephthalic acid, 4-chlorodiperoxyphthalic acid, diperoxyisophthalic acid, peroxy benzoic acids and ring-substituted peroxy benzoic acids, such as peroxy-alpha-naphthoic acid. A preferred aromatic peroxyacid is diperoxyisophthalic acid.

Another preferred class of peroxygen compounds which can be incorporated to enhance dispensing/dispersibility in water are the anhydrous perborates described for that purpose in the applicants' European patent specification EP-A-217,454.

It is particularly preferred to include in the compositions, a stabiliser for the bleach or bleach system, for example ethylene diamine tetramethylene phosphonate and diethylene triamine pentamethylene phosphonate or other appropriate organic phosphonate or salt thereof, such as the Dequest range hereinbefore described. These stabilisers can be used in acid or salt form, such as the calcium, magnesium, zinc or aluminium salt form. The stabliser may be present at a level of up to about 1% by weight, preferably between about 0.1% and about 0.5% by weight.

The applicants have also found that liquid bleach precursors, such as glycerol triacetate and ethylidene heptanoate acetate, isopropenyl acetate and the like, also function suitably as a solvent, thus obviating or reducing any need of additional relatively volatile solvents, such as the lower alkanols, paraffins, glycols and glycolethers and the like, e.g. for viscosity control.

The third category of major other ingredients are abrasives, particularly for incorporation in hard surface cleaners (liquid abrasive cleaners). These will inevitably be incorporated as particulate solids. They may be those of the kind which are water insoluble, for example calcite. Suitable materials of this kind are disclosed in the applicants' patent specifications EP-A-50,887; EP-A-80,221; EP-A-140,452; EP-A-214,540 and EP 9,942, which relate to such abrasives when suspended in aqueous media.

The abrasives may also be water soluble, especially in the form of particles of any solid water soluble salt hereinafter described, for example as an inorganic builder. Inert particulate solid salts having no particular function in fabrics washing, other than as bulking agents in detergent powders, e.g. sodium sulphate, may also be used for this purpose. Especially preferred are the water soluble abrasives described in the applicants' patent specification EP-A-193,375.

The secondary (minor) other ingredients comprise those remaining ingredients which may be used in liquid cleaning products, such as fabric conditioning agents, enzymes, perfumes (including deoperfumes), micro-biocides, colouring agents, fluorescers, soil-suspending agents (anti-redeposition agents), corrosion inhibitors, enzyme stabilizing agents, and lather depressants.

Amongst the fabric conditioning agents which may be used, either in fabric washing liquids or in rinse conditioners, are fabric softening materials such as fabric softening clays, quaternary ammonium salts, imidazolinium salts and fatty amines. Typical suitable quaternary ammonium salts and imidazolinium salts are described in specification EP-A-122,141 whilst examples of appropriate fatty amines are described in GB 1,514,276. Other fabric conditioners are anti-harshening agents such as cellulases, anti-static agents and drape imparting agents.

Usually, fabric softening clays are phyllosilicate clays with a 2:1 layer structure, which definition includes pyprophyllite clays, smectite or montmorillonite clays, saponites, vermiculites and micas. Clay materials which have been found to be unsuitable for fabric softening purposes include chlorites and kaolinires. Other aluminosilicate materials which do not have a layer structure, such as zeolites are also unsuitable as fabric softening clay materials. Particularly suitable clay materials are the smectite clays described in detail in U.S. Pat. No. 3,959,155 (Montgomery et al, assigned to The Procter & Gamble Company), incorporated herein by reference, especially smectite clays such as described in U.S. Pat. No. 3,936,537 (Baskerville), also incorporated herein by reference. Other disclosures of suitable clay material for fabric softening purposes include European patent specification EP-A-26,528 (Procter & Gamble Limited).

The most preferred clay fabric softening materials include those materials of bentonitic origin, bentonites being primarily montmorillonite type clays together with various impurities, the level and nature of which depends on the source of the clay material.

The level of fabric softening clay material in the compositions of the invention should be sufficient to provide the fabrics with a softening benefit. A preferred level is 1.5% to 35% by weight of the composition, most preferably from 4% to 15%, these percantages referring to the level of the clay material per se. Levels of clay raw material higher than this may be necessary when the raw material is derived from a particularly impure source.

Cellulase anti-harshening agents may be any bacterial or fungal cellulase having a pH optimum of between 5 and 11.5. It is however preferred to use cellulases which have optimum activity at alkaline pH values, such as those described in British Patent Specifications GB 2 075 028 A (Novo Industrie A/S), GB 2 095 275 A (Kao Soap Co Ltd) and GB 2 094 826 A (Kao Soap Co Ltd).

Examples of such alkaline cellulases are cellulases produced by a strain of *Humicola insolens* (*Humicola grisea var. thermoidea*), particularly the Humicola strain DSM 1800, and cellulases produced by a fungus or Bacillus N or a cellulase 212-producing fungus belonging to the genus Aeromonas, and cellulase extracted from the hepatopancreas of a marine mollosc (Dolabella Auricula Solander).

The Cellulase added to the composition of the invention may be added to the liquid in the form of a non-dusting granulate, e.g. "marumes" or "prills". . , or in the form of a liquid in which the cellulase is provided as a cellulase liquid concentrate suspended in e.g. a non-ionic surfactant or dissolved in another non-aqueous medium, having cellulase activity of at least 250 regular $C_x$ cellulase activity units/gram, measured under the standard conditions as described in GB 2 075 028 A. The liquid component of such a concentrate then becomes incorporated as part of the solvent.

The amount of cellulase in the composition of the invention will, in general, be from about 0.1 to 10% by weight in whatever form. In terms of cellulase activity, the use of cellulase in an amount corresponding to from 0.25 to 150 or higher regular $C_x$ units/gram of the liquid product is preferred. Most preferred range of cellulase activity, however, is from 0.5 to 25 regular $C_x$ units/-gram of the liquid.

Suitable anti-static agents which may be incorporated are quaternary ammonium salts of the formula $[R_1R_2R_3R_4N]^+Y^-$ wherein at least one, but not more than two, of $R_1$, $R_2$, $R_3$, and $R_4$ is an organic radical containing a group selected from a $C_{16}$–$C_{22}$ aliphatic radical, or an alkyl phenyl or alkyl benzyl radical having 10–16 atoms in the alkyl chain, the remaining group or groups being selected from hydrocarbyl groups containing from 1 to about 4 carbon atoms, or $C_2$–$C_4$ hydroxy alkyl groups and cyclic structures in which the nitrogen atom forms part of the ring, and Y is an anion such as halide, methylsulphate, or ethylsulphate.

In the context of the above definition, the hydrophobic moiety (i.e. the $C_{16}$–$C_{22}$ aliphatic, $C_{10}$–$C_{16}$ alkyl phenyl or alkyl benzyl radical) in the organic radical $R_1$ may be directly attached to the quaternary nitrogen atom or may be indirectly attached thereto through an amide, esters, alkoxy, ether, or like grouping.

The quaternary ammonium anti-static agents can be prepared in various ways well known in the art. Many such materials are commercially available.

Enzymes which can be used in liquids according to the present invention include proteolytic enzymes, amylolytic enzymes and lipolytic enzymes (lipases). Various types of proteolytic enzymes and amylolytic anzymes are known in the art and are commercially available. They may be incorporated as "prills" or "marumes" etc, such as is hereinbefore described in respect of cellulases.

The fluorescent agents which can be used in the liquid cleaning products according to the invention are well known and many such fluorescent agents are available commercially. One suitable class comprises the diaminostilbene disulphonate cyanuric chloride (DAS/CC) derivatives. The main constituents of the DAS/CC type fluorescers are the 4,4'-bis[(4-anilio-6-substituted-1,3,5 triazin-2-yl)amino]stilbene-2,2' disulphonic acids, and their salts, especially the alkali metal or alkanolamino salts, in which the substituted group is either morpholino, hydroxyethylmethylamino, hydroxyethylamino, methylamino or dihydroxyethylamino. Specific fluorescent agents which may be mentioned by way of example are:

(a) 4,4'di(2"-anilino-4"-morpholinotriazin-6"-ylamino)-stilbene-2,2'-disulphonic acid and its salts,
(b) 4,4'-di(2'-anilino-4"-N-methylethanolaminotriazin-6"-ylamino)-stilbene-2,2'-disulphonic acid and its salts,
(c) 4,4'-di(2"-anilino-4"-diethanolaminotrazin-6"-ylamino)-stilbene-2,2'-disulphonic acid and its salts,
(d) 4,4-di (2"-anilino-4"-dimethylaminotriazin-6"-ylamino)-silbene-2,2'-disulphonic acid and its salts,
(e) 4,4'-di(2"-anilino-4"-diethylaminotriazin-6"-ylamino)-stilbene-2,2'-disulphonic acid and its salts,
(f) 4,4'-di (2"-anilino-4"-monoethanolaminotriazin-6"-ylamino)-silbene-2,2'-disulphonic acid and its salts,
(g) 4,4'-di (2"-anilino-4"-(1-methyl-2-hydroxy)ethylaminotriazin-6 "-ylamino)-stilbene-2,2'-disulphonic acid and its salts,
(h) 4,4'-di (2"-methylamino-4"-p-chloroanilinotriazin-6"-ylamino)-stilbene-2,2'-disulphonic acid and its salts,
(i) 4,4'-di(2"-dietholamine-4"-sulphanilinotriazin-6"-ylamino) -stilbene-2,2'-disulphonic acid and its salts,
(j) 4,4'-di(3-sulphostyryl)diphenyl and its salts,
(k) 4,4 '-di (4-phenyl-1,2,3-triazol-2-yl)-stilbene-2,2'-disulphonic acid and its salts,
(l) 1-(p-sulphonamidophenyl)-3-(p-chlorophenyl)-Δ2-pyrazoline.

Usually, these fluorescent agents are supplied and used in the form of their alkali metal salts, for example, the sodium salts. In addition to these fluorescent agents, the liquid cleaning products of the invention may contain other types of fluorescent agents as desired. The total amount of the fluorescent agent or agents used in a detergent composition is generally from 0.02–2% by weight.

When it is desired to include anti-redeposition agents in the liquid cleaning products, the amount thereof is normally from about 0.1% to about 5% by weight, preferably from about 0.2% to about 2.5% by weight of the total liquid composition. Preferred anti-redeposition agents include carboxy dderivatives of sugars and celluloses, e.g. sodium carboxymethyl cellulose, anionic poly-electrolytes, especially polymeric aliphatic carboxylates, or organic phosphonates.

Preferred corrosion inhibitors are alkali metal silicates, particularly sodium ortho-, meta- or preferably neutral or alkaline silicate, e.g. at levels of at least about 1%, and preferably from about 5% to about 15% by weight of the total liquid product.

In general, the solids content of the product may be within a very wide range, for example from 1–90%, usually from 10–80% and preferably from 15–70%, especially 15–50% by weight of the final composition. The alkaline salt should be in particulate form and have an average particle size of less than 300 microns, preferably less than 200 microns, more preferably less than 100 microns, especially less than 10 microns. The particle size may even be of sub-micron size. The proper particle size can be obtained by using materials of the appropriate size or by milling the total product in a suitable milling apparatus.

The compositions are substantially non-aqueous, i.e. they little or no free water, preferably no more than 5%, preferably less than 3%, especially less than 1% by weight of the total composition. It has been found by the applicants that the higher the water content, the more likely it is for the viscosity to be too high, or even for setting to occur. However, this may at least in part be overcome by use of higher amounts of, or more effective structurants/deflocculants.

Since the objective of a non-aqueous liquid will generally be to enable the formulator to avoid the negative influence of water on the components, e.g. causing incompatibility of functional ingredients, it is clearly necessary to avoid the accidental or deliberate addition of water to the product at any stage in its life. For this reason, special precautions are necessary in manufacturing procedures and pack designs for use by the consumer.

Thus during manufacture, it is preferred that all raw materials should be dry and (in the case of hydratable salts) in a low hydration state, e.g. anhydrous phosphate builder, sodium perborate monohydrate and dry calcite abrasive, where these are employed in the composition. In a preferred process, the dry, substantially anhydrous solids are blended with the solvent in a dry vessel. In order to minimise the rate of sedimentation of the solids, this blend is passed through a grinding mill or a combination of mills, e.g. a colloid mill, a corundum disc mill, a horizontal or vertical agitated ball mill, to achieve a particle size of 0.1 to 100 microns, preferably 0.5 to 50 microns, ideally 1 to 10 microns. A preferred combination of such mills is a colloid mill followed by a horizontal ball mill since these can be operated under the conditions required to provide a narrow size distribution in the final product. Of course particulate material already having the desired particle size need not be subjected to this procedure and if desired, can be incorporated during a later stage of processing.

During this milling procedure, the energy input results in a temperature rise in the product and the liberation of air entrapped in or between the particles of the solid ingredients. It is therefore highly desirable to mix any heat sensitive ingredients into the product after the milling stage and a subsequent cooling step. It may also be desirable to de-aerate the product before addition of these (usually minor) ingredients and optionally, at any other stage of the process. Typical ingredients which might be added at this stage are perfumes and enzymes, but might also include highly temperature sensitive bleach components or volatile solvent components which may be desirable in the final composition. However, it is especially preferred that volatile material be introduced after any step of aeration. Suitable equipment for cooling (e.g. heat exchangers) and de-aeration will be known to those skilled in the art.

It follows that all equipment used in this process should be completely dry, special care being taken after any cleaning operations. The same is true for subsequent storage and packing equipment.

As mentioned above, the pack should also minimise the risk of water being introduced to the product. Particularly suitable designs for this purpose have been described in South African patent application 87/2272 in which the product is charged to a unit dosing chamber which communicates with the body of the container before the cap is removed. During the operation of removal of the cap, this communication route is closed and the user pours out the pre-measured dose. Any rinsing of this dosing chamber does not allow water to run back into the bulk of the product. On replacement of the cap, the communication route between the dosing chamber and the body of the container is re-opened ready for the next charging operation (e.g. by tilting the container).

Alternative packs which are particularly suitable have a narrow opening spout of 0.5 to 8 mm orifice diameter, preferably 1 to 5 mm, especially 2–3 mm, through which the product can be poured (possibly aided by squeezing the body of the container) but through which it is inconvenient for the user to attempt to add water to the contents. It is generally found that the high shear rates created by squeezing the product through such a narrow opening are sufficient to lower the product viscosity to an extent to permit easy flow. This characteristic of the products of the invention to have a low viscosity at high shear rates has been described hereinbefore and is demonstrated in the examples.

A further pack option which is especially suitable for some classes of product which could be formulated with non-aqueous liquid (e.g. fabric washing detergents or warewashing products) incorporates a unit dose of the product, e.g. in a sachet or a small pot with a tear-open device. After opening, the entire contents of such a pack would then be consumed in a single use of the product. Optionally, the packs can be sized such that, say, 2–4 are required thereby giving the consumer a degree of flexibility to adjust product usage to the specific operation. A further option which is particularly suited to the non-aqueous liquids of this invention is to fabricate the sachet or the sealant film of the small pot from a water-soluble polymeric material such that the entire container can be charged into the washing liquor, wherefrom the contents will be released upon dissolution of the sachet or the film. A particularly suitable polymeric material for this purpose which is known to those familiar with packaging materials, is polyvinyl alcohol. Suitable grades are available for this purpose.

Containers with pump-action dispensers may also be used since these will allow product to be removed whilst effectively preventing entry of water.

The invention will now be better explained by way of the following examples.

In the examples, a number of materials are referred to by trade names etc. These are:

Synperonic A3 : nonionic surfactant comprising $C_{13-15}$ fatty alcohol alkoxylated with an average of 3 moles of ethylene oxide (ex ICI).

Synperonic A5 : nonionic surfactant comprising $C_{13-15}$ fatty alcohol alkoxylated with an average of 5 moles of ethylene oxide (ex ICI)

Dobanol 91-5T : nonionic surfactant comprising $C_{9-11}$ fatty alcohol alkoxylated with an average of 5 moles of ethylene oxide (ex Shell).

Dobanol 91/6 : nonionic surfactant comprising $C_{9-11}$ fatty alcohol alkoxylated with an average of 6 moles of ethylene oxide (ex Shell).

Plurafac RA30 : nonionic surfactant comprising $C_{13-15}$ fatty alcohol and alkoxylated with an average of 4–5 moles of ethylene oxide and 2–3 moles of propylene oxide (ex ICI).

Versa TL3 polystyrene maleic anhydride sulphonate sodium salt (ex National Adhesives and Resins Limited).

Sokalan CP5 : acrylic acid/maleic acid co-polymer, average molecular weight 70,000, acrylic acid:maleic acid ratio 1:1.

PEG 200 : polyethylene glycol HO $(CH_2CH_2O)_nH$, average molecular weight 200 (ex Merck).

Aerosil : fine particle (highly voluminous) silica carrier material as described in GB 1,205,711, GB 1,270,040 and GB 1,292,352.

Aerosol OT : Sodium dioctyl sulphosuccinate (ex Merck/Cyanamid).

Arosurf : Distearyl dimethyl ammonium chloride quaternary amine cationic surfactant (ex Sherex)

EXAMPLE 1

The following non-aqueous liquid detergent compositions were prepared.

| | A % by weight | B % by weight |
|---|---|---|
| $C_{13}$–$C_{15}$ linear primary alcohol condensed with 4.9 moles of ethylene oxide and 2.7 moles of propylene oxide | 38.5 | 33.1 |
| Dodecyl benzene sulphonic acid | — | 6.0 |
| Glycerol triacetate | 5.0 | 5.0 |
| Pentasodium triphosphate (anh.) | 30.0 | 30.0 |
| Soda ash | 4.0 | 4.0 |
| Sodium perborate monohydrate (13.4%) + sodium oxoborate (2.10%) | 15.5 | 15.5 |
| Tetraacetyl ethylene diamine | 4.0 | 4.0 |
| Ethylene diamine tetramethylene phosphonic acid | 0.10 | 0.10 |
| Ethylene diamine tetraacetate (sodium salt) | 0.15 | 0.15 |
| Proteolytic enzyme (Savinase T granulate) | 0.6 | 0.6 |
| Highly voluminous silica (Aerosil) | 0.6 | — |
| Sodium carboxymethyl cellulose | 1.0 | 1.0 |
| Fluorescer | 0.3 | 0.3 |
| Perfume | 0.25 | 0.25 |

Composition B is in accordance with the present invention whilst composition A is structured with highly voluminous silica, as described in GB 1,270,040 and GB 1,292,352. The following physical data were measured after 3 months (except where indicated):

| | | |
|---|---|---|
| Viscosity (mPas at 21 $sec^{-1}$ at room temperature) initially | 730 | 2092 |
| Viscosity (mPas at 21 $sec^{-1}$) after storage at room temperature | 875 | 1609 |
| Sediment (in %) | less than 1 | less than 1 |
| Setting (in %)* | 75 | 0 |
| Phase separation (%-room temp) | 5.0 | 9.0 |
| Phase separation (%-at 37° C.) | 5.0 | 11.0 |

*The setting was measured after storage for 2 weeks at 37° C. by placing a bottle containing the product in a horizontal position and measuring the percentage of product which remained in an unchanged position. This setting was reversible by shaking

EXAMPLE 2

The following products were made according to the invention

| | % by weight | |
|---|---|---|
| | C | D |
| $C_{13}$-$C_{15}$ linear primary alcohol condensed with 4.9 moles of ethylene oxide and 2.7 moles of propylene oxide | 36.7 | 33.6 |
| Dodecylbenzene sulphonic acid | 1.0 | 4.0 |
| Glycerol triacetate | 5.0 | 5.0 |
| Zeolite type 4A (activated) | — | 26.0 |
| Maleic anhydride/methacrylate copolymer | — | 6.0 |
| Sodium carbonate (anh.) | 29.5 | 4.0 |
| Calcium carbonate (Socal $U_3$) | 6.0 | — |
| Sodium perborate monohydrate | 13.4 | 13.4 |
| Sodium oxoborate | 2.1 | 2.1 |
| Tetraacetyl ethylene diamine | 4.0 | 4.0 |
| Polyacrylate | 0.5 | — |
| Sodium carboxymethyl cellulose | 1.0 | 1.0 |
| Ethylene diamine tetraacetate (sodium salt) | 0.15 | 0.15 |
| Protease (Savinase) granulate | 0.6 | 0.6 |
| Fluorescer | 0.3 | 0.3 |
| Perfume | 0.25 | 0.25 |
| These products showed the following physical data (conditions as Example 1): | | |
| Viscosity (mPas at $21^{-1}$) at room temperature initially | 3113 | 2547 |
| Viscosity after 54 days' storage | 2925 | 1912 |
| Sedimentation (in %) | 1 | 1 |
| Setting (in %) | 0 | 0 |
| Phase separation at room temperature (in %) | 3.4 | — |
| Phase separation at 37° C. | 4.2 | 5 |

EXAMPLE 3

The addition of dodecylbenzene sulphonic acid to a composition as in Example 1 A, but containing 0.4% silica instead of 0.6, had no significant effect on viscosity at low shear rates, whereas without silica a significant decrease in the viscosity at low shear rate was measured.

EXAMPLE 4

The composition of Example 1B was reproduced by replacing the whole of the dodecyl benzene sulphonic acid with the structurants listed below, in the amounts specified. The viscosity at ambient temperature of each liquid was measured at a shear rate of $20s^{-1}$, substantially immediately and after 1, 2 and 4 weeks. In all cases, the viscosity at low shear rate was noticibly reduced as compared with the viscosity of systems indentical except for absence of the specified structurant, although in the longer term some formulations showed some viscosity increase.

| | Amount | Viscosity in mPas S at $20s^{-1}$ | | | |
|---|---|---|---|---|---|
| Structurant | % | immed. | 1 wk. | 2 wk. | 4 wk. |
| A. Oleic Acid | 0.1 | 769 | 736 | 665 | 621 |
| B. Glacial Acetic Acid | 0.1 | 763 | 709 | 692 | 710 |
| C. Toluene Sulphonic Acid | 0.05 | 603 | 568 | * | * |
| D. Trichloracetic Acid | 0.5 | 665 | 585 | * | * |
| E. Methane Sulphonic Acid | 0.25 | 781 | 745 | 763 | 772 |
| F. Acetic Anhydride | 0.1 | 834 | 763 | 657 | 683 |
| G. Sulphuric Acid (96%) | 0.1 | 657 | 638 | * | * |
| H. Phosphorus Pentoxide | 0.1 | 532 | 514 | 532 | 497 |
| I. Lauric Acid | 0.1 | 1966 | 2056 | 1966 | 1788 |
| J. Aerosol OT (after heating & dissolution) | 0.5 | 861 | 807 | 754 | 692 |

*sedimentation prevented measurement

EXAMPLE 5

The composition of Example 2D was reproduced, replacing whole of the dodecyl benzene sulphonic acid with the structurants listed below, in the amounts specified. The same measurements were performed in Example 4.

| | Amount | Viscosity in mPas S at $20s^{-1}$ | | | |
|---|---|---|---|---|---|
| Structurant | (%) | immed. | 1 wk. | 2 wk. | 4 wk. |
| A. Oleic Acid | 0.05 | 1535 | 1473 | 1402 | 1109 |
| B. Glacial Acetic Acid | 0.1 | 1579 | 1508 | 1473 | 1295 |
| C. Toluene Sulphonic Acid | 0.01 | 1375 | 1278 | 1242 | 958 |
| D. Trichloracetic Acid | 0.5 | 1411 | 1366 | 1411 | 1402 |
| E. Methane Sulphonic Acid | 0.1 | 1473 | 1402 | 1366 | 1171 |
| F. Acetic Anhydride | 0.25 | 1877 | 1877 | 1966 | 1446 |
| G. Sulphuric Acid (96%) | 0.25 | 2503 | 2503 | 2324 | 2056 |
| H. Phosphorus Pentoxide | 0.05 | 1348 | 1340 | 1260 | 1082 |
| I. Lauric Acid | 0.05 | 1659 | 1966 | 1966 | 1419 |
| J. Aerosol OT (after heating & dissolution) | 0.5 | 1446 | 1446 | 1411 | 1206 |

In order to assess the effects of further variations in solids, solvent and structurants, experiments were performed with 'model' systems, i.e. containing only the latter three categories of ingredient. In all cases, the volume fraction of solids was chosen as that sufficient to enable the effect of deflocculation to be sufficiently apparent so that a comparison between the different systems could be made.

The basic experiments performed were measurements of viscosity at different shear rates and determination of the sedimentation rate (mm/hr) determined by standing the relevant sample in a measuring cylinder. It must be noted that the formulations were selected to enable comparisons to be made easily and the relative proportions of ingredients do not necessarily correspond to those which would be used in an acceptable commercial product. Thus, the sedimentation recorded here is often quite rapid. However, a commercial formulation would be based on the relative proportions of the ingredients found on analysis of the lower separated (yet pourable) layer. Certain systems which set in the longer term are included.

The trends in sedimentation rate data fall into one of two categories. First, those systems where onset of an apparent network formation (in the absence of structurant) is rapid. Such a network would not sediment. Thus, addition of structurant which seems to breakdown the network would actually increase the sedimentation rate. Then, settling of the individual particles would proceed as predicted by Stokes law until the final stable volume is achieved. In the second category, without structurant, there appears to be no substantially immediate onset of network formation. In that case, the particles just tend to agglomerate to form flocs which are larger and therefore sink more rapidly. The addition of structurant to cause deflocculation into discrete particles would then case a decrease in sedimentation rate.

Only systems which (relative to those with no structurant) show a decrease in viscosity at low shear rate, at least immediately after preparation, are in accordance with the invention. Thus, in these systems, those where sodium chloride is the 'structurant' are in many cases excluded, although with other solids/solvent combinations, it may be suitable.

In Examples 6–19, the following notation applies:

After a value or other entry * gassing (s) long-term setting

In place of a value S long term setting —measurement not performed (+) apparatus incapable of performing measurement

EXAMPLE 6–9

In each of these Examples, twenty combinations of particulate solids and structurants were tested, coded I–XX, according to the following Table. However, a different solvent was used for each Example and the weight/volume fraction of solids was also varied. In each case, the amount of structurant added was 2% by weight.

| Combination | Solids/Structurant Combinations: Particulate Solids | Structurant |
|---|---|---|
| I | STP 0.aq | None |
| II | " | NaCl |
| III | " | TCA |
| IV | " | ABSA |
| V | " | $FeCl_3$ |
| VI | Hydrated Zeolite | None |
| VII | " | NaCl |
| VIII | " | TCA |
| IX | " | ABSA |
| X | " | $FeCl_3$ |
| XI | Sodium Perborate Monohydrate | None |
| XII | " | NaCl |
| XIII | " | TCA |
| XIV | " | ABSA |
| XV | " | $FeCl_3$ |
| XVI | $Na_2CO_3$ | None |
| XVII | " | NaCl |
| XVIII | " | TCA |
| XIX | " | ABSA |
| XX | " | $FeCl_3$ |

TCA = Trichloracetic Acid
ABSA = Alkyl (i.e. dodecyl) benzenesulphonic Acid (as free acid)
STP 0.aq = Sodium Tripolyphosphate (anhydrous)

EXAMPLE 6

The solvent was Synperonic A3.

| Solids | Weight fraction % | Volume fraction % |
|---|---|---|
| A. Viscosity Measurement at Various Shear rates | | |
| STP 0.aq | 70 | 46 |
| Hydrated Zeolite | 58 | 39 |
| Na Perborate Monohydrate | 52 | 33 |
| $Na_2CO_3$ | 58 | 33 |

| Solids/Structurant Combination | Viscosity (Pas) at $s^{-1}$ Shear Rate:- 1.25 | 2.50 | 5.00 | 80 | 160 |
|---|---|---|---|---|---|
| I | 200 | 100 | 50 | (+) | — |
| II | 42 | 21 | 12 | 3 | — |
| III | 65 | 34 | 19 | 3 | — |
| IV | 9 | 6 | 4 | 3 | — |
| V | S | S | S | S | — |
| VI | 7.1 | 4.8 | 2.6 | — | 0.9 |
| VII | 7.4 | 4.3 | 2.7 | — | 1.0 |
| VIII | 6.2 | 3.8 | 2.4 | — | 1.1 |
| IX | 3.0 | 2.1 | 1.5 | — | 1.0 |
| X | S | S | S | — | S |
| XI | 7.3 | 3.5 | 3.6 | 2.5 | (+) |
| XII | 6.4 | 4.2 | 3.1 | — | 2.0 |
| XIII | 8.8 | 5.8 | 4.3 | 2.8 | (+) |
| XIV | 3.6 | 2.6 | 2.1 | — | 1.5 |
| XV | S | S | S | — | S |
| XVI | 11.7 | 8.0 | 5.5 | 3.3 | — |
| XVII | 14.4 | 9.8 | 8.4 | 4.1 | — |
| XVIII | S | S | S | S | — |
| XIX | 4.3 | 3.5 | 3.2 | 3.2 | — |
| XX | S | S | S | S | — |

| Solids | Weight fraction % | Volume fraction % |
|---|---|---|
| B. Sedimentation Rate | | |
| STP 0.aq | 56 | 32 |
| Hydrated Zeolite | 31 | 17 |
| Na Perborate Monohydrate | 28 | 15 |
| $Na_2CO_3$ | 31 | 14 |

| Solid/Structurant Combination | Sed. Rate (mm/hr) |
|---|---|
| I | 6 |
| II | 9 |
| III | 9 |
| IV | 0.7 |
| V | — |
| VI | 2.5 |
| VII | 3.2 |
| VIII | 2.2 |
| IX | 0.1 |
| X | — |
| XI | 2.9 |
| XII | 2.9 |
| XIII | 2.5 |
| XIV | 2.0 |
| XV | — |
| XIV | 2.5 |
| XVII | 3.0 |
| XVIII | 3.2 |
| XIX | 1.6 |
| XX | — |

EXAMPLE 7

The solvent was Dobanol 91/6.

| Solids | Weight fraction % | Volume fraction % |
|---|---|---|
| A. Viscosity Measurements at Various Shear Rates | | |
| STP 0.aq | 70 | 48 |
| Hydrated Zeolite | 58 | 40 |
| Na Perborate Monohydrate | 52 | 35 |

-continued

| $Na_2CO_3$ | 58 | | | 30 | | |
|---|---|---|---|---|---|---|
| Solid/structurant Combination | Viscosity (Pas) at $s^{-1}$ Shear Rate | | | | | |
| | 1.25 | 2.50 | 5.00 | 40 | 80 | 160 |
| I | 72 | 36 | 19 | 6 | — | — |
| II | 51 | 29 | 16 | 7 | — | — |
| III | 36 | 19 | 10 | 3 | — | — |
| IV | 16 | 12 | 11 | 6 | — | — |
| V | 33 | 34 | 28 | (+) | — | — |
| VI | 9 | 6 | 4 | — | 2 | (+) |
| VII | 9 | 6 | 4 | — | 2 | (+) |
| VIII | 3 | 5 | 3 | — | 1 | 1 |
| IX | 11 | 8 | 5 | — | 3 | (+) |
| X | S | S | S | — | S | — |
| XI | 9.6 | 6.2 | 5.0 | — | 3.5 | — |
| XII | 10.1 | 6.8 | 5.4 | — | 3.8 | — |
| XIII | 18.7* | 13.6* | 12.8* | (+) | (+) | — |
| XIV | 10.8 | 7.3 | 5.5 | — | 3.1 | — |
| XV | S | S | S | — | S | — |
| XVI | 15.6 | 3.7 | 3.3 | — | 3.4 | — |
| XVII | 4.3 | 3.6 | 3.5 | 4.0 | (+) | — |
| XVIII | 45.8* | 26.4* | 13.9* | 4.9* | (+) | — |
| XIX | 8.0 | 5.2 | 3.8 | — | 2.6 | — |
| XX | S | S | S | — | S | — |

| Solids | Weight fraction | Volume fraction % |
|---|---|---|
| | B. Sedimentation Rate | |
| STP 0.aq | 37 | 19 |
| Hydrated Zeolite | 31 | 18 |
| Na Perborate Monohydrate | 28 | 16 |
| $Na_2CO_3$ | 43 | 22 |

| Solid/Structurant Combination | Sed. Rate (mm/hr) |
|---|---|
| I | 14 |
| II | 15 |
| III | S |
| IV | 17 |
| V | — |
| VI | 1.3 |
| VII | 2.9 |
| VIII | 2.5 |
| IX | 1.3 |
| X | — |
| XI | 1.3 |
| XII | 1.3 |
| XIII | 1.3 |
| XIV | 1.2 |
| XV | — |
| XIV | 0.51 |
| XVII | 0.51 |
| XVIII | 0.16 |
| XIX | 0.37 |
| XX | — |

EXAMPLE 8

The solvent was PEG 200.

| Solids | Weight fraction % | Volume fraction % |
|---|---|---|
| | A. Viscosity Measurements at Various Shear Rates | |
| STP 0.aq | 65 | 46 |
| Hydrated Zeolite | 48 | 34 |
| Na Perborate Monohydrate | 46 | 32 |
| $Na_2CO_3$ | 54 | 33 |

| Solid/structurant Combination | Viscosity (Pas) at $s^{-1}$ Shear Rate | | | | | |
|---|---|---|---|---|---|---|
| | 1.25 | 2.50 | 5.00 | 40 | 80 | |
| I | 11.1 | 10.5 | 10.4 | — | 7.2 | — |
| II | 11.9 | 11.4 | 11.8 | 9.5 | (+) | — |
| III | 25.8 | 19.7 | 15.0 | 9.9 | (+) | — |
| IV | 28.6 | 20.7 | 16.4 | 12.8 | (+) | — |
| V | S | S | S | S | — | — |
| VI | 2.4 | 2.4 | 3.9 | — | 7.8 | — |

-continued

| | | | | | | |
|---|---|---|---|---|---|---|
| VII | 1.4 | 1.4 | 2.8 | — | 8.9 | — |
| VIII | 1.7 | 2.1 | 3.4 | — | 4.9 | — |
| IX | 2.1 | 2.8 | 3.9 | — | 6.1 | — |
| X | S | S | S | — | S | — |
| XI | 3.1 | 2.4 | 2.5 | — | — | 2.6 |
| XII | 5.4 | 5.4 | — | — | 6.8 | (+) |
| XIII | 3.8 | 3.7 | 3.6 | — | — | 3.4 |
| XIV | 3.8 | 3.4 | 3.3 | — | — | 3.1 |
| XV | S | S | S | — | — | S |
| XVI | S* | S* | S* | — | — | S* |
| XVII | S* | S* | S* | — | — | S* |
| XVIII | S* | S* | S* | — | — | S* |
| XIX | S* | S* | S* | — | — | S* |
| XX | S* | S* | S* | — | — | S* |

NB. In many of these systems, the low shear viscosity of the composition is already low in the absence of structurant and this could (for example) be due to structuring by trace impurities in the solvent. In any event, this solvent material is very suitable in combination with surfactant solvent materials.

| | B. Sedimentation Rate | |
|---|---|---|
| Solids | Weight fraction % | Volume fraction % |
| STP 0.aq | 52 | 33 |
| Hydrated Zeolite | 38 | 26 |
| Na Perborate Monohydrate | — | — |
| $Na_2CO_3$ | — | — |

| Solid/Structurant Combination | Sed. Rate (mm/hr) |
|---|---|
| I | 0.7 |
| II | 1.4 |
| III | — |
| IV | 0.4 |
| V | — |
| VI | 0.01 |
| VII | 0.03 |
| VIII | 0.01 |
| IX | 0.01 |
| X | — |

EXAMPLE 9

The solvent was Plurafac RA30

| Solids | Weight fraction % | Volume fraction % |
|---|---|---|
| STP 0.aq | 63 | 39 |
| Hydrated Zeolite | 40 | 25 |
| Na Perborate Monohydrate | 48 | 31 |
| $Na_2CO_3$ | 59 | 35 |

| Solids/Structurant Combination | Viscosity (Pas) at $s^{-1}$ Shear Rate:- | | | | | | |
|---|---|---|---|---|---|---|---|
| | 1.25 | 2.50 | 5.00 | 40 | 80 | 160 | 320 |
| I | 54 | 27 | 19 | — | — | 1 | — |
| II | 80 | 41 | 23 | — | — | 2 | — |
| III | 8 | 2 | 2 | — | — | 1 | — |
| IV | 2 | 2 | 1 | — | — | 1 | — |
| V | 2 | 2 | 2 | — | — | 1 | — |
| VI | 82 | 41 | 22 | — | — | 1 | — |
| VII | 96 | 50 | 26 | — | — | 1 | — |
| VIII | 1 | 1 | 0.5 | — | — | 0.5 | — |
| IX | 3 | 2 | 1 | — | — | 0.5 | — |
| X | 4 | 3 | 3 | — | — | 2 | — |
| XI | 138 | 73 | 41 | — | 7 | (+) | — |
| XII | 130 | 69 | 38 | — | 8 | (+) | — |
| XIII | 10 | 6 | 4 | — | — | 2 | — |
| XIV | 3 | 5 | 4 | — | — | 2 | — |
| XV | S | S | S | — | — | S | — |

-continued

| | | | | | | | |
|---|---|---|---|---|---|---|---|
| XVI | 34 | 24 | 16 | — | — | — | 9 |
| XVII | 55 | 38 | 31 | — | — | — | 11 |
| XVIII | 27* | 24* | 19* | 23* | — | — | (+) |
| XIX | 36* | 22* | 23* | — | — | — | 8* |
| XX | S | S | S | — | — | — | S |

B. Sedimentation Rate

| Solids | Weight fraction % | Volume fraction % |
|---|---|---|
| STP 0.aq | 33 | 16 |
| Hydrated Zeolite | 21 | 12 |
| Na Perborate Mono-hydrate | 26 | 14 |
| $Na_2CO_3$ | 31 | 15 |

| Solid/Structurant Combination | Sed. Rate (mm/hr) | Solid/Structurant Combination | Sed. Rate (mm/hr) |
|---|---|---|---|
| I | 14 | XI | 0.45 |
| II | 14 | XII | 0.44 |
| III | 11 | XIII | 0.46 |
| IV | 5 | XIV | 3.1 |
| V | 3 | XV | — |
| VI | 0.91 | XIV | 2.7 |
| VII | 0.68 | XVII | 2.3 |
| VIII | 1.60 | XVIII | 0.9 |
| IX | 3.19 | XIX | 1.0 |
| X | (+) | XX | — |

EXAMPLE 10—EFFECT OF NONIONIC

Using those samples from Examples 6–9 which contained no structurant, the viscosity after about one week storage was as given in the following Table.

| | | STP | Zeo Hydr | Perb Mono | Na Carb |
|---|---|---|---|---|---|
| | Solids w/w% | 63 | 40 | 48 | 59 |
| | Solids Vol % | 39 | 25 | 31 | 35 |
| | | Viscosity in Pas | | | |
| Visc. at $1.25s^{-1}$ | Plur. RA30 | 54 | 82 | 138 | 34 |
| | Dob. 91/6 | 72 | 9.0 | 9.6 | 15.6 |
| | Synp A3 | 200 | 7.1 | 7.3 | 11.7 |
| | PEG 200 | 11.1 | 2.4 | 3.1 | S* |
| $2.50s^{-1}$ | Plur. RA30 | 27 | 41 | 73 | 24 |
| | Dob 91/6 | 36 | 6 | 6.2 | 3.7 |
| | Synp A3 | 100 | 4.8 | 3.5 | 8.0 |
| | PEG 200 | 10.5 | 2.4 | 2.4 | S* |
| $5.00s^{-1}$ | Plur. RA30 | 15 | 22 | 41 | 16 |
| | Dob 91/6 | 19 | 4.0 | 5.0 | 3.3 |
| | Synp A3 | 50 | 2.6 | 3.6 | 5.5 |
| | PEG 200 | 10.4 | 3.9 | 2.5 | S* |
| (40) | Plur. RA30 | 1 | 1 | [7] | 9 |
| [80] or | Dob. 91/6 | (6) | [2] | [3.5] | [3.4] |
| $160s^{-1}$ | Synp. A3 | (+) | 0.9 | (+) | [3.3] |
| | PEG 200 | (7.2) | (7.8) | [2.6] | S* |

It can be seen that in all cases, the low shear viscosity measurement was lowest with the polyethylene glycol samples. This is at least partly due to the inherently lower viscosity of that solvent but may be due to partial deflocculation by impurities in the solvent and/or by the acidic nature of the terminal—OH group of the solvent molecules. With the other solvents, the deflocculation performance was Plurafac RA30>Dobanol 91/6>Synperonic A3 for all solids except STP where the trend was exactly the reverse.

EXAMPLE 11

In Examples 6–9, it was demonstrated that deflocculation can be detected by the reduction of viscosity at low shear rates. However, sedimentation rate measurements were not in themselves, ready predictors of the effect. It was explained hereinbefore, that by performing sedimentation rate measurements at different solids volume fractions, it was possible to extrapolate to a rate at substantially zero solids volume fractions to determine the sedimentation rate for a single deflocculated particle in isolation (although of course it is somewhat anomalous to refer to an isolated particle being deflocculated). From the extrapolated rate, an apparent particle size can be calculated from Stokes law.

This approach was used to demonstrate the effect of adding increasing amounts of acid, which is the method whereby optimum structurant concentrations can be determined.

Using STP as the solids, Plurafac RA30 as the solvent and dodecyl benzene sulphonic acid as the structurant (deflocculant), the effect of adding increasing amounts of ABSA was observed at a variety of solids volume fractions. Below, viscosity (low and high shear rate) measurements are reproduced at a solids level high enough to demonstrate deflocculation by that means (63% w/w, 39% v/v). Sedimentation rate measurements at a slightly lower solids content (36% v/v) are also given but even there, it will be seen that the trend is not clear. However, extrapolated sedimentation rate results and calculated apparent particle sizes show a clear trend. The optimum structurant level is around 2–5% with a small viscosity increase occurring at the higher end.

| | Solids 63 w/w, 37% v/v | | | Solids 36% v/v | Extrapolation to 0% v/v Solids | |
|---|---|---|---|---|---|---|
| ABSA added | Viscosity (Pas) at $0.78s^{-1}$ | Viscosity (Pas) at $3.12s^{-1}$ | Viscosity (Pas) at $439.92s^{-1}$ | Sed. Rate ($10^{-2}$ mm/hr) | Sed. Rate (mm/hr) | Calculated Apparent Particle Size (μm) |
| 0 | 103 | 35 | 1.7 | 0.3 | 725 | 53 |
| 0.01 | 85 | 27 | 1.4 | 2.9 | 436 | 45 |
| 0.1 | 51 | 14.5 | 1.0 | 4.2 | — | — |
| 0.2 | — | — | — | 13.6 | 168 | 28 |
| 0.4 | 6.3 | 2.7 | 1.0 | 32.4 | — | — |
| 1.0 | 4.8 | 2.2 | 1.2 | 4.5 | 57 | 16 |
| 2 | 5.5 | 3.5 | 1.2 | — | — | — |
| 5 | 9.5 | 6.8 | 1.5 | — | 9 | 7 |
| 10 | 31.2 | 24.5 | 3.1 | 0.1 | 9 | 7 |

EXAMPLE 12

The effect of using solvent completely devoid of surfactant properties was tested using 73% w/w (54% v/v) STP in both acetone and di-isopropyl ether, with and without 2% ABSA as structurant. The deflocculation effect as determined by reduction in low shear viscosity was very marked with both solvents. Exact measurements with structurant in acetone were not possible due to partial evaporation during the course of the experiment. The low viscosity of both solvents resulted in rapid settling, so that ideally, a stable product would have the composition of the bottom layer, which remained pourable.

| | | Viscosity (Pas) at Shear Rate:- | | |
|---|---|---|---|---|
| Solvent | Structurant | $0.78s^{-1}$ | $3.12s^{-1}$ | $439.92s^{-1}$ |
| Acetone | None | >200 | >100 | >3.2 |
| | ABSA | (+) Liquid | (+) Liquid | 0.8 |
| Di-isopropyl ether | None | >200 | >100 | >3.2 |
| | ABSA | 1.1 | 0.7 | 0.7 |

EXAMPLE 13

An experiment similar to that described in Example 12 was performed using a 9:1 (by weight) mixture of Plurafac RA30 with acetone. The deflocculation effect was determined by means of low shear rate viscosity reduction. The result was compared with that using 100% of the nonionic. Solids were 73% w/w (54% v/v) STP. The structurant was 2% ABSA.

| | | Viscosity (Pas) at $S^{-1}$ Shear Rate:- | | | | |
|---|---|---|---|---|---|---|
| Solvent | Structurant | 1.25 | 2.50 | 5.00 | 80 | 160 |
| Plurafac | | | | | | |
| RA30 | None | 7.9 | 36.4 | 20.3 | 3.3 | (+) |
| " | ABSA (2%) | 3.8 | 3.0 | 2.7 | 1.8 | 1.5 |
| 9:1 Plurafac | None | 6.3 | 28.5 | 14.8 | 2.0 | (+) |
| RA30/Acetone | ABSA (2%) | 1.86 | 1.42 | 1.06 | 0.69 | 0.56 |

EXAMPLE 14

Structurant: 2% copper stearate [$Cu(St)_2$], solvent: Plurafac RA30, solids: hydrated zeolite (40% w/w;25% v/v)

| | Viscosity (Pas) at Shear Rate:- | | |
|---|---|---|---|
| Structurant | $0.78s^{-1}$ | $3.12s^{-1}$ | $439.9s^{-1}$ |
| — | 76 | 22 | 5.0 |
| $Cu(St)_2$ | 15 | 4.0 | 5.0 |

EXAMPLE 15

To determine setting tendency, different structurants were investigated at 2% by weight with 63% w/w (39% v/v) STP in Plurafac RA30. A subjective assessment was made of the ease of pouring from a bottle both before and after storage for 65 hours at 50° C. The setting was also determined by the bottle tilting procedure described in Example 1. The percentage so obtained is given in the far-right hand column in the table below.

| | Flow at "pour" Shear Rate | | |
|---|---|---|---|
| Structurant | Before Storage | After 65 h storage at 50° C. | Setting in "bottle-tilt-test" after 65 h storage at 50° C. |
| None | No | No | 100 |
| NaCl | No | No | 100 |
| TCA | easy | no | 100 |
| ABSA | very easy | very easy | 0 |
| $FeCl_3$ | easy | no | 100 |
| Urea | no | no | 100 |
| Arosurf (Quat. ammon. Cationic) | no | no | 100 |
| $Al(St)_3$ | easy | no | 100 |
| Empiphos | very easy | no | 100 |
| $Cu(St)_2$ | easy | no | 100 |
| Lecithin | very easy | very easy | 0 |
| Carboxy nonionic* | very easy | no | 100 |

*succinic anhydride half esterified with Dobanol 91/6. Urea, Arosurf, aluminium stearate, Empiphos and carboxy nonionic are all materials described in the Colgate prior art.

EXAMPLE 16—LIQUID ABRASIVE CLEANER MODEL

ABSA at 2% by weight was used to deflocculate 35%w/w (16%v/v) calcite in Plurafac RA30

| | Viscosity (Pas) at Shear Rate:- | | | | |
|---|---|---|---|---|---|
| Structurant | $1.25s^{-1}$ | $2.50s^{-1}$ | $5.00s^{-1}$ | $80s^{-1}$ | $160s^{-1}$ |
| — | 75 | 41 | 22 | 2.8 | (+) |
| ABSA | 14 | 8 | 5 | 1.3 | 1.1 |

EXAMPLE 17

Lecithin at 2% by weight was used to deflocculate the amounts of the solids shown below, in Plurafac RA30.

| | | | | Viscosity (Pas) at Shear Rate:- | | |
|---|---|---|---|---|---|---|
| Solids | Solid w/w % | Solid vol % | Structurant | $1.25s^{-1}$ | $80s^{-1}$ | $160s^{-1}$ |
| STP | 63 | 39 | None | 54.4 | — | 1.3 |
| | | | Lecithin | 4.5 | — | 0.8 |
| Hydrt Zeolite | 40 | 25 | None | 81.7 | — | 1.2 |
| | | | Lecithin | 5.8 | — | 0.4 |
| Na Perb. 48 | 31 | None | 137.5 | 7.2 | (+) | |
| Mono. | | | Lecithin | 6.3 | — | 1.5 |

EXAMPLE 18

Anhydrous (activated) zeolite at 2% by weight was used to deflocculate the amounts of the solids shown below, in Plurafac RA30.

| | | | | (Pas) at Shear Rate:- | |
|---|---|---|---|---|---|
| Solid | Solid w/w % | Solid vol % | Structurant | $1.25s^{-1}$ | $160s^{-1}$ |
| STP | 63 | 39 | None | 54.4 | 1.3 |
| | | | Act. Zeolite | 2.2 | 1.1 |
| Perb. Mono. | 48 | 31 | None | 137.5 | 7.2 |
| | | | Act. Zeolite | 4.8 | 2.1 |
| Zeolite Hydrated | 40 | 25 | None | 81.7 | 1.2 |
| | | | Act. Zeolite | 8.2 | 0.5 |
| $Na_2CO_3$ | 59 | 35 | None | 34.4 | 9.3 |

-continued

| Solid | Solid w/w % | Solid vol % | Structurant | (Pas) at Shear Rate:- 1.25s$^{-1}$ | 160s$^{-1}$ |
|---|---|---|---|---|---|
| | | | Act. Zeolite | 12.5 | (+) |

EXAMPLE 19

The effect of various structurant parameters on deflocculation (determined by low viscosity shear rate reduction) was investigated for hydrated zeolite (33% w/w; 20% v/v) in Plurafac RA30. In all cases, the amount of structurant was 2% by weight.

The parameters investigated were (a) lipophilic chain length, (b) acid strength and (c) 'complex forming capacity'.

| | | | Structurant | Viscosity (Pas) at Shear Rate:- 1.25s$^{-1}$ | 3.12s$^{-1}$ | 440s$^{-1}$ |
|---|---|---|---|---|---|---|
| | | | (a) Length of Lipophilic Chain | | | |
| A | Sulphonic Acids | incr chain length ↓ | None | 75.9 | 21.9 | 0.6 |
| | | | Methane Sulphonic Acid | 38.0 | 9.6 | 0.6 |
| | | | Paratoluene Sulphonic Acid | 17.4 | 6.0 | 0.6 |
| | | | Alkyl benzene sulphonic acid | 2.0 | 1.6 | 0.3 |
| B | Carboxylic Acids | incr chain length ↓ | Acetic Acid (Ethanoic acid) | 39.8 | 15.5 | 0.6 |
| | | | Stearic acid (Octadecanoic acid) | 26.3 | 8.5 | 0.6 |
| | 87 | C7090 | | | | |
| | | | (b) Acid Strength | | | |
| A | Acetic Acids | incr acidity ↓ | None | 75.9 | 21.9 | 0.6 |
| | | | Acetic acid | 39.8 | 15.5 | 0.5 |
| | | | Trichlor acetic acid | 5.4 | 2.3 | 0.4 |
| | | | Trifluor acetic acid | (+) | 0.3 | 0.4 |
| B | Stearates | incr acidity ↓ | Sodium stearate | 89.1 | 26.3 | 0.6 |
| | | | Stearic acid | 26.3 | 8.5 | 0.6 |
| | | | (c) 'Complex forming capacity' | | | |
| | | incr complex forming capacity ↓ | None | 75.9 | 21.9 | 0.6 |
| | | | Na-stearate | 89.1 | 26.3 | 0.6 |
| | | | $Al(St)_3$ | 35.5 | 9.1 | 0.4 |
| | | | $Cu(St)_2$ | 14.8 | 4.3 | 0.4 |

EXAMPLE 20

Aerosol OT at.2% by weight was used to deflocculate 63% v/v (39% w/w) STP in Plurafac RA30. Prior to the viscosity measurements, the composition was heated to 100° C. for about 1 hour and allowed to cool to room temperature. Viscosity was measured at various shear rates. For comparison, the figures from Example 9 with no structurant are reproduced here

| Structurant | Viscosity (Pas) at s$^{-1}$ Shear Rate:- 1.25 | 2.50 | 5.00 | 80.0 | 160 |
|---|---|---|---|---|---|
| None | 54 | 27 | 19 | — | 1 |

-continued

| Structurant | Viscosity (Pas) at s$^{-1}$ Shear Rate:- 1.25 | 2.50 | 5.00 | 80.0 | 160 |
|---|---|---|---|---|---|
| Aerosol OT | 3.7 | 2.3 | 1.7 | 1.0 | 0.85 |

EXAMPLE 21—FURTHER COMPLETE PHOSPHATE—BUILT FORMULATIONS

| | Compositions (% by weight) A | B | C | D | E | F | G |
|---|---|---|---|---|---|---|---|
| Solvent | | | | | | | |
| Plurafac RA30 | 36.1 | 34.1 | 37.0 | — | — | — | — |
| Dobanol 91-6 | — | — | — | 36.6 | 36.6 | — | — |
| Dobanol 91-5T | — | — | — | — | — | 36.6 | 36.6 |
| Glyceryl-Triacetate | 5.0 | 5.0 | 5.0 | 5.0 | 5.0 | 5.0 | 5.0 |
| Structurant | | | | | | | |
| ABSA | 3.0 | 3.0 | 3.0 | 3.0 | 3.0 | 3.0 | 3.0 |
| Solids | | | | | | | |
| STP 0.aq | 30.0 | 30.0 | 29.3 | 30.0 | 30.0 | 30.0 | 30.0 |
| Soda Ash | 4.0 | — | 4.0 | — | — | — | — |
| Na Perborate Mono. Hy. | 13.4 | 13.0 | 15.05 | 15.0 | 13.0 | 15.0 | 13.0 |
| Na Peroxoborate | 2.1 | 2.0 | — | — | 2.0 | — | 2.0 |
| TAED | 4.0 | 4.0 | 4.0 | 4.0 | 4.0 | 4.0 | 4.0 |
| Minors* | ← balance → | | | | | | |

*Selected from Enzyme, bleach, stabiliser, corrosion inhibitor, anti-redeposition agent, fluorescer, perfume (substantially as Example 1).

All of these compositions are fully formulated fabrics washing compositions according to the present invention.

EXAMPLE 22—FURTHER COMPLETE PHOSPHATE—FREE FORMULATIONS

| | Compositions (% by weight) | | | | | |
|---|---|---|---|---|---|---|
| | A | B | C | D | E | F |
| Solvent | | | | | | |
| Plurafac RA30 | 38.6 | 38.6 | 38.6 | 36.2 | — | — |
| Glyceryl Tri-Acetate | 5.0 | 5.0 | 5.0 | 5.0 | — | — |
| Dobanol 91-6 | — | — | — | — | 41.3 | — |
| Synperonic A3 | — | — | — | — | — | 12.4 |
| Synperonic A5 | — | — | — | — | — | 28.9 |
| Monoethanolamine | — | — | — | — | 0.5 | 0.5 |
| Structurant | | | | | | |
| ABSA | 1.0 | 1.0 | — | 1.0 | 2.3 | 2.3 |
| Lecithin | — | — | 1.0 | — | — | — |
| Solids | | | | | | |
| Hydrated Zeolite | — | 24.0 | 24.0 | — | — | — |
| Activated Zeolite | 24.5 | — | — | — | — | — |
| Sokalan CP5 | 5.5 | 5.5 | 5.5 | — | — | — |
| Versa TL3 | — | — | — | 0.5 | — | — |
| Soda Ash | — | 4.5 | 4.5 | 29.9 | 42.2 | 42.2 |
| Calcite Socal U3 | — | — | — | 6.0 | 6.8 | 6.8 |
| Na perborate Mono. hy. | 13.0 | 15.0 | 15.0 | 13.0 | 6.0 | 6.0 |
| Na Peroxoborate | 2.0 | — | — | 2.0 | 0.9 | 0.9 |
| TAED | 4.0 | 4.0 | 4.0 | 4.0 | — | — |
| Minors* | | | ← balance → | | | |

*as Example 21 (substantially as Example 2)

All of these compositions are fully formulated fabrics washing compositions according to the present invention.

We claim:

1. A substantially non-aqueous non-setting liquid cleaning product having a viscosity below 10 Pas at a shear rate of 5 $s^{-1}$ or more, when stored at 50° C., for 64 hours immediately after preparation, wherein said liquid cleaning product comprises:

1) from 20% to 70% by weight of a non-aqueous organic solvent comprising polyalkoxylated fatty alcohol nonionic surfactant;
2) from 15% to 70% by weight particles of solid materials dispersed in the solvent; and
3) from 0.01% to 15% by weight of a structurant selected from the group consisting of:
   a) deflocculant alkyl, alkenyl, aryl, aralkyl and aralkenyl mono-carboxylic acids, and halogenated derivatives thereof;
   b) deflocculant anionic surfactants in the acid form, having a sulphonic acid moiety; and
   c) mixtures thereof.

2. A cleaning product according to claim 1, wherein the fatty alcohol is polyethoxylated.

3. A cleaning product according to claim 1, wherein the fatty alcohol is polyalkoxylated with both ethoxy and propoxy groups.

4. A cleaning product according to claim 1, wherein the non-aqueous organic solvent comprises a blend of a polyethoxylated fatty alcohol with a fatty alcohol polyalkoxylated with both ethoxy and propoxy groups.

5. A cleaning product according to claim 1, wherein the solvent further comprises a non-surfactant material, the molecules of said material comprising a lipophilic moiety bonded to a hydrophobic moiety having one or more electron pairs.

6. A cleaning product according to claim 5, wherein the non-surfactant material comprises an ether; a poly ether; a substituted amine selected from the group consisting of an alkylamine, a fatty-amine, a di-alkylamine, a trialkylamine, a fatty-N-substituted amine and mixtures thereof; an alkyl or fatty-amide or a mono- or di-N-alkyl substituted derivative thereof; an alkyl or fatty carboxylic acid ester; a ketone; an aldehyde or a glyceride.

7. A process for preparing a non-aqueous liquid having a viscosity below 10 Pas at a shear rate of 5 $s^{-1}$ or more, comprising from 20% to 70% by weight of a non-aqueous organic solvent, comprising polyalkoxylated fatty alcohol nonionic surfactant, from 15% to 70% by weight particles of solid materials, dispersed in the solvent, wherein from 0.01% to 15% by weight of a structurant, selected from the group consisting of:

a) deflocculant alkyl, alkenyl, aryl, aralkyl and aralkenyl mono-carboxylic acids, and halogenated derivatives thereof;
b) deflocculant anionic surfactants in the acid from having sulphonic acid moiety; and
c) mixtures thereof, is added in the acid form to the non-aqueous organic solvent.

* * * * *